US011986709B2

(12) United States Patent
Murphy et al.

(10) Patent No.: US 11,986,709 B2
(45) Date of Patent: May 21, 2024

(54) MULTI-MATERIAL GOLF CLUB HEAD

(71) Applicant: Acushnet Company, Fairhaven, MA (US)

(72) Inventors: Stephen S. Murphy, Carlsbad, CA (US); Richard Sanchez, Temecula, CA (US); Grant M. Martens, San Diego, CA (US); Stephanie Luttrell, Carlsbad, CA (US); Christopher D. Harvell, San Marcos, CA (US); Darryl C. Galvan, El Cajon, CA (US); Noah de la Cruz, San Diego, CA (US); David S. Cornelius, San Marcos, CA (US)

(73) Assignee: Acushnet Company, Fairhaven, MA (US)

( * ) Notice: Subject to any disclaimer, the term of this patent is extended or adjusted under 35 U.S.C. 154(b) by 233 days.

(21) Appl. No.: 17/168,083

(22) Filed: Feb. 4, 2021

(65) Prior Publication Data

US 2021/0154539 A1 May 27, 2021

Related U.S. Application Data

(60) Division of application No. 16/542,090, filed on Aug. 15, 2019, now Pat. No. 10,940,371, which is a continuation-in-part of application No. 16/042,979, filed on Jul. 23, 2018, now Pat. No. 10,653,927.

(51) Int. Cl.
*A63B 53/04* (2015.01)
*A63B 60/54* (2015.01)

(52) U.S. Cl.
CPC ..... *A63B 53/0466* (2013.01); *A63B 60/54* (2015.10); *A63B 53/0412* (2020.08); *A63B 53/042* (2020.08); *A63B 53/0437* (2020.08); *A63B 2209/00* (2013.01)

(58) Field of Classification Search
CPC ... A63B 53/0466; A63B 60/54; A63B 53/042; A63B 53/0412; A63B 53/0437; A63B 2209/00; A63B 53/0433; A63B 53/0408
USPC ..... 473/324–350, 287–292
See application file for complete search history.

(56) References Cited

U.S. PATENT DOCUMENTS

| | | | |
|---|---|---|---|
| 1,485,685 | A | 3/1924 | Alexander |
| 1,562,956 | A | 11/1925 | Guerne |
| 3,387,844 | A | 6/1968 | Winsor |
| 3,556,532 | A | 1/1971 | Ballmer |
| 5,064,197 | A | 11/1991 | Eddy |
| 5,106,094 | A | 4/1992 | Desbiolles |
| 5,362,055 | A | 11/1994 | Rennie |
| 5,431,396 | A | 7/1995 | Shieh |
| 5,467,983 | A | 11/1995 | Chen |
| 5,499,814 | A | 3/1996 | Lu |
| 5,718,641 | A | 2/1998 | Lin |

(Continued)

*Primary Examiner* — Sebastiano Passaniti
(74) *Attorney, Agent, or Firm* — Randy K. Chang

(57) ABSTRACT

A golf club head that is capable of preserving the metallic acoustic signature of an entirely metallic golf club head all while utilizing a lightweight composite material is disclosed herein. More specifically, the golf club head in accordance with the present invention creates a frontal acoustic chamber in conjunction with a rear weight saving chamber via a panel member barrier is disclosed. The panel member may even be combined with an optimized thickness relationship at the transition region between the striking face portion and the panel member to further optimize the performance of the golf club head.

19 Claims, 25 Drawing Sheets

(56) References Cited

U.S. PATENT DOCUMENTS

RE35,955 E 11/1998 Lu
6,165,081 A 12/2000 Chou
6,299,547 B1 10/2001 Kosmatka
6,348,013 B1 * 2/2002 Kosmatka ..... A63B 60/00 473/345
6,383,090 B1 5/2002 O'Doherty
6,602,149 B1 8/2003 Jacobson
6,612,938 B2 9/2003 Murphy
6,695,715 B1 2/2004 Chikaraishi
6,852,038 B2 2/2005 Yabu
6,878,073 B2 4/2005 Takeda
7,056,228 B2 6/2006 Beach
7,097,572 B2 * 8/2006 Yabu ..... A63B 60/46 473/345
7,166,038 B2 1/2007 Williams
7,303,488 B2 * 12/2007 Kakiuchi ..... A63B 53/0466 473/345
7,413,520 B1 8/2008 Hocknell
7,621,824 B2 * 11/2009 Sano ..... A63B 53/0466 473/345
7,762,909 B2 * 7/2010 Sugimoto ..... A63B 53/0466 473/346
8,187,116 B2 5/2012 Boyd
8,214,992 B2 * 7/2012 Hirano ..... A63B 53/0466 473/345
8,602,912 B2 12/2013 Stites
8,651,975 B2 2/2014 Soracco
8,849,635 B2 9/2014 Hayase
9,011,267 B2 * 4/2015 Burnett ..... A63B 60/00 473/332
9,144,721 B2 * 9/2015 Golden ..... A63B 60/00
9,192,826 B2 * 11/2015 Golden ..... A63B 53/0466
9,403,295 B2 8/2016 Sander
9,517,394 B1 12/2016 Dacey
10,245,479 B2 4/2019 Murphy
10,265,588 B2 * 4/2019 Aramaki ..... A63B 53/0466
10,471,311 B2 * 11/2019 Kato ..... A63B 53/0466
10,653,927 B2 * 5/2020 Murphy ..... A63B 60/54
10,940,371 B2 * 3/2021 Murphy ..... A63B 60/002
11,219,805 B2 * 1/2022 Larsen ..... A63B 60/00
2002/0094884 A1 * 7/2002 Hocknell ..... C23F 1/26 473/347
2004/0033844 A1 2/2004 Chen
2004/0097301 A1 * 5/2004 Lee ..... A63B 60/00 473/342
2004/0138001 A1 * 7/2004 Sano ..... A63B 53/0466 473/324
2004/0204265 A1 10/2004 Chang
2005/0075192 A1 4/2005 Han
2006/0148589 A1 7/2006 Liou
2007/0207877 A1 * 9/2007 Nishio ..... A63B 53/0466 473/345
2010/0029409 A1 2/2010 Noble
2010/0048325 A1 * 2/2010 Tanimoto ..... A63B 60/02 29/527.5
2010/0323812 A1 12/2010 Boyd
2015/0360094 A1 12/2015 Deshmukh
2017/0136318 A1 * 5/2017 Murphy ..... A63B 53/0466

* cited by examiner

MULTI-MATERIAL GOLF CLUB HEAD

CROSS-REFERENCE TO RELATED APPLICATIONS

The present application is a Divisional (DIV) of U.S. patent application Ser. No. 16/542,090, Filed Aug. 15, 2019, which is a Continuation-In-Part (CIP) of U.S. patent application Ser. No. 16/042,979, filed Jul. 23, 2018, now U.S. Pat. No. 10,653,927, the disclosure of which are all incorporated by reference in their entirety herein.

FIELD OF THE INVENTION

The present invention relates generally to a new and improved golf club having a secondary barrier behind a striking face portion via a panel member. The panel member allows the golf club head to incorporate exotic materials at the rear aft portion of the golf club head without sacrificing performance. The panel member may even be combined with an optimized thickness relationship at the transition region between the striking face portion and the panel member to further optimize the performance of the golf club head. More specifically the secondary barrier preserves the acoustic characteristics of a metallic golf club head while allowing the rear aft portion of the golf club head to be made out of exotic materials that may generally degrade the acoustic characteristics of a golf club head.

BACKGROUND OF THE INVENTION

The utilization of lightweight materials in a golf club head is generally known. The utilization of lightweight materials in a golf club head removes mass from specific portions of the golf club head and allows it to be redistributed to more optimized areas. U.S. Pat. No. 6,612,938 to Murphy et al. illustrates one of the earlier attempts to use exotic materials in a golf club head such as plies of pre-preg material.

However, despite the potential gains in the discretionary mass gained by the utilization of such lightweight material, the utilization of such material usually comes with some drawbacks. More specifically, the utilization of such lightweight material may generally come with an undesirable acoustic characteristic, making the golf club undesirable to a golfer irrespective of performance.

U.S. Pat. No. 5,064,197 to Eddy back in 1991 provides one of the earlier attempts to adjust the acoustic characteristics of a golf club by providing a first forward chamber in the head opening to the club head face, wherein the forward chamber vibrates at a given primary frequency.

U.S. Pat. No. 8,651,975 to Soracco provided another example of an attempt to address the acoustic characteristics associated with golf clubs that utilizes exotic material. More specifically, Soracco provided a golf club head with sound tuning composite members forming at least a portion of the surface of the golf club head.

Finally, U.S. Pat. No. 8,849,635 to Hayase et al. went above and beyond the mere basic design of a golf club head for acoustic characteristics and even made an attempt to predict modal damping ratio of composite golf club heads.

Despite the above, none of the references provide a method to improve the performance of a golf club head by providing a way to improve the performance of a golf club head utilizing advanced materials all while providing a clean way to address the degradation of the acoustic characteristics of the golf club head. Hence, it can be seen from the above that a golf club design that is capable of achieving both of the goal of incorporating exotic lightweight materials in order to increase discretionary mass as well as achieving a desirable acoustic characteristic while minimizing the undesirable sound and feel of the golf club head.

BRIEF SUMMARY OF THE INVENTION

One aspect of the present invention is a golf club head comprising of a frontal acoustic chamber located at a front side of the golf club head and made out of a first material having a first volume, and a rear weight saving chamber located rearward of the frontal acoustic chamber at least partially made out of a second material having a second volume, wherein the frontal acoustic chamber and the rear weight saving chamber are separated by a panel member that bifurcates the golf club head by connecting to a crown portion and a sole portion, and wherein said second material has a lower density than said first material, and wherein the golf club head has a Front to Rear Volume Ratio of less than about 0.35, the Front to Rear Volume Ratio defined as the first volume of the frontal acoustic chamber divided by a second volume of the rear weight saving chamber.

In another aspect of the present invention is a golf club head comprising of a frontal acoustic chamber located at a front side of the golf club head and made out of a first material having a first volume, and a rear weight saving chamber located rearward of the frontal acoustic chamber at least partially made out of a second material having a second volume, wherein the frontal acoustic chamber and the rear weight saving chamber are separated by a panel member that bifurcates the golf club head by connecting to a crown portion and a sole portion, and wherein said second material has a lower density than said first material, and wherein the panel member is further comprised of an upper sub-panel member, a middle sub-panel member, and a lower sub-panel member, and all three panel members are all placed at different angles relative to a striking face.

In another aspect of the present invention is a golf club head comprising of a frontal acoustic chamber located at a front side of the golf club head and made out of a first material having a first volume, and a rear weight saving chamber located rearward of the frontal acoustic chamber at least partially made out of a second material having a second volume, wherein the frontal acoustic chamber and the rear weight saving chamber are separated by a panel member that bifurcates the golf club head by connecting to a crown portion and a sole portion, and wherein said second material has a lower density than said first material, wherein the panel member is curved away from the front side of the golf club head such that a center of the panel member is placed further away from a striking face than at a crown and a sole portion of the panel member.

In another aspect of the present invention, the panel member further comprises of a pressure release hole having an aspect ratio of between about 1.6 and about 2.0.

In another aspect of the present invention, the pressure release hole cut out from the panel member has a major axis distance of greater than about 80 mm and has a minor axis distance of greater than about 50 mm.

In another aspect of the present invention, the golf club head further comprises of a sole transition region having a thickness of between 3 mm to about 10 mm and a crown transition region having a thickness of between about 3.0 mm to about 4.5 mm In another aspect of the present invention, the golf club head further comprises of a crown transition region having a crown transition slope of between about 0.25 to 0.625, and a sole transition region having a sole transition slope of between about 0.57 to about 2.

In another aspect of the present invention, the golf club head further comprises of a ratio of a crown transition slope divided by a sole transition slope is between about 0.125 to about 1.096.

These and other features, aspects and advantages of the present invention will become better understood with reference to the following drawings, description and claims.

BRIEF DESCRIPTION OF THE DRAWINGS

The foregoing and other features and advantages of the invention will be apparent from the following description of the invention as illustrated in the accompanying drawings. The accompanying drawings, which are incorporated herein and form a part of the specification, further serve to explain the principles of the invention and to enable a person skilled in the pertinent art to make and use the invention.

DETAILED DESCRIPTION OF THE INVENTION

The following detailed description describes the best currently contemplated modes of carrying out the invention. The description is not to be taken in a limiting sense, but is made merely for the purpose of illustrating the general principles of the invention, since the scope of the invention is best defined by the appended claims.

Various inventive features are described below and each can be used independently of one another or in combination with other features. However, any single inventive feature may not address any or all of the problems discussed above or may only address one of the problems discussed above. Further, one or more of the problems discussed above may not be fully addressed by any of the features described below.

Figure 1:
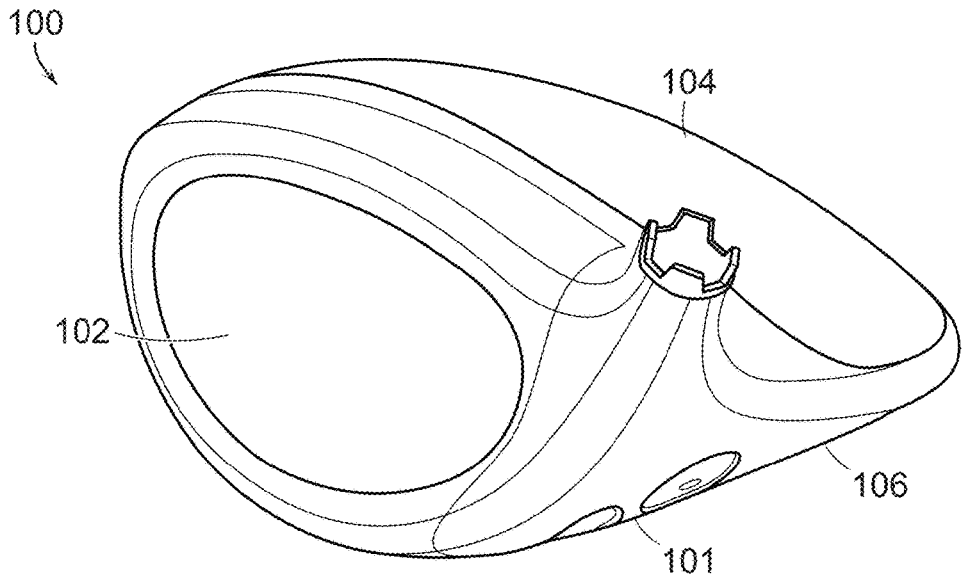
FIG. 1 of the accompanying drawings shows a frontal perspective view of a golf club head in accordance with the present invention.

FIG. 1 of the accompanying drawings shows a perspective view of a golf club head 100 in accordance with an exemplary embodiment of the present invention. The golf club head 100 shown in FIG. 1 provides only a rough sketch of the externals components of the golf club head 100 without illustrating the internal workings of the golf club head 100. More specifically, golf club head 100 will generally have a striking face 102 placed at a frontal portion of a chassis 101 the golf club head 100, a sole portion 106 located at the bottom of an aft portion of the chassis 101, and a crown portion 104 located at the top of an aft portion of the chassis 101. The striking face 102, together with the chassis 101, which includes the frontal portion and the skirt portion, may generally be made out of a first material having a density of between about 4.0 g/cc and about 4.7 g/cc, more preferably between about 4.1 g/cc and about 4.6 g/cc, and most preferably about 4.4 g/cc. The first material in most cases may generally be a titanium metallic material such Titanium 8-1-1, ATI 425 Titanium, SP 700 Titanium, KS 120 Titanium, KS 100 Titanium, Ti 6-4, or any other type of titanium material having the density recited above without departing from the scope and content of the present invention. However, in alternative embodiments of the present invention, the first material may be steel in a fairway type of construction without departing from the scope and content of the present invention. The crown portion 104 and the sole portion 106 in accordance with this embodiment of the present invention may be made out of a second lightweight material having a lower density than the remainder of the golf club head in order to achieve the weight savings desired without departing from the scope and content of the present invention. The lightweight second material could be made out of aluminum type material with a density of between about 2.5 g/cc and about 2.9 g/cc, a magnesium material with a density of about 1.738 g/cc, a wooden material that may have a density as low as 0.6 g/cc, but most commonly a fiber reinforced plastic composite type material may be used having a density of between about 1.2 g/cc to about 1.8 g/cc. More information regarding composite materials with a low fiber areal mass in a golf club head may be found in U.S. Patent Publication 2015/0360094 to Deshmukh, the disclosure of which is incorporated by reference in its entirety. Although not visible from FIG. 1, the golf club head 100 in accordance with this embodiment of the present invention may be internally separated into a frontal acoustic chamber and a rear weight saving member, creating a dual chambered golf club head 100 that is capable of achieving improved performance characteristics by increasing the discretionary weight of the golf club all while preserving the acoustic signature of the golf club head 100.

Figure 2:
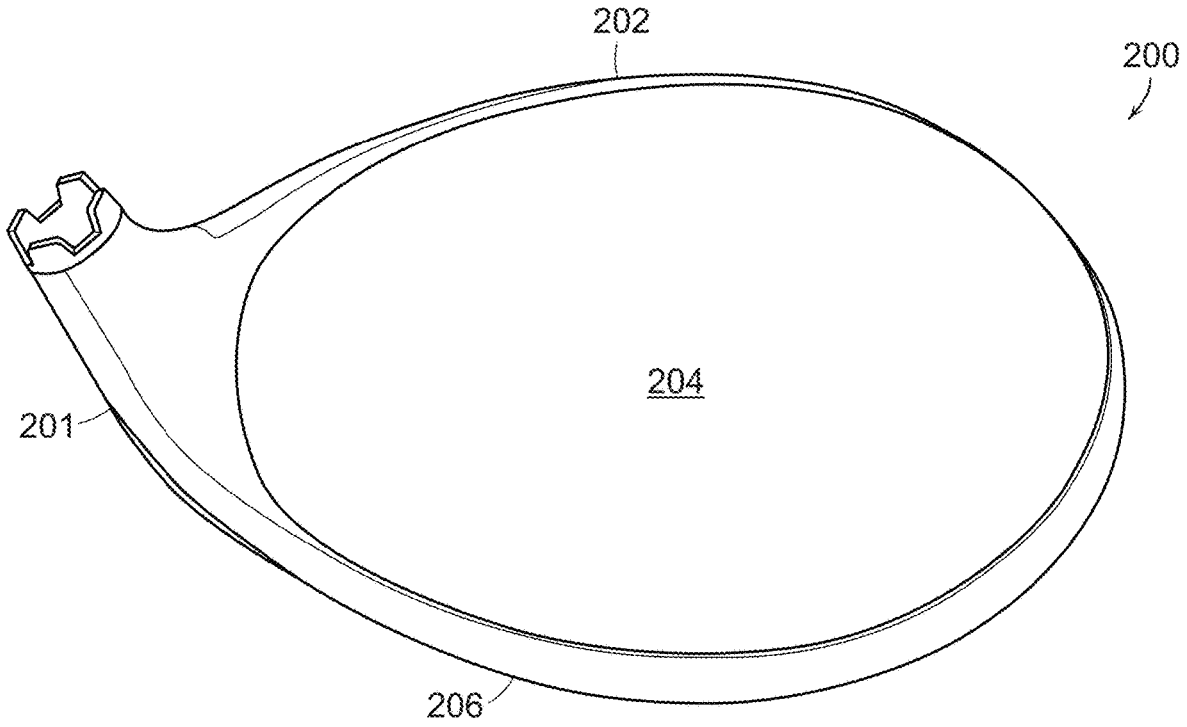
FIG. 2 of the accompanying drawings shows a rear perspective view of a golf club head in accordance with the present invention.

FIG. 2 of the accompanying drawings shows a rear perspective view of a golf club head 200 in accordance with an alternative embodiment of the present invention. Golf club head 200 may generally be comprised out of very similar components illustrated in FIG. 1, comprising of a metallic chassis 201, a striking face 202, a crown 204, and a sole 206. However, in this angle shown in FIG. 2, the internal components of the golf club head 200 can be shown more clearly if the crown 204 cover is removed for illustration purposes.

Figure 3:
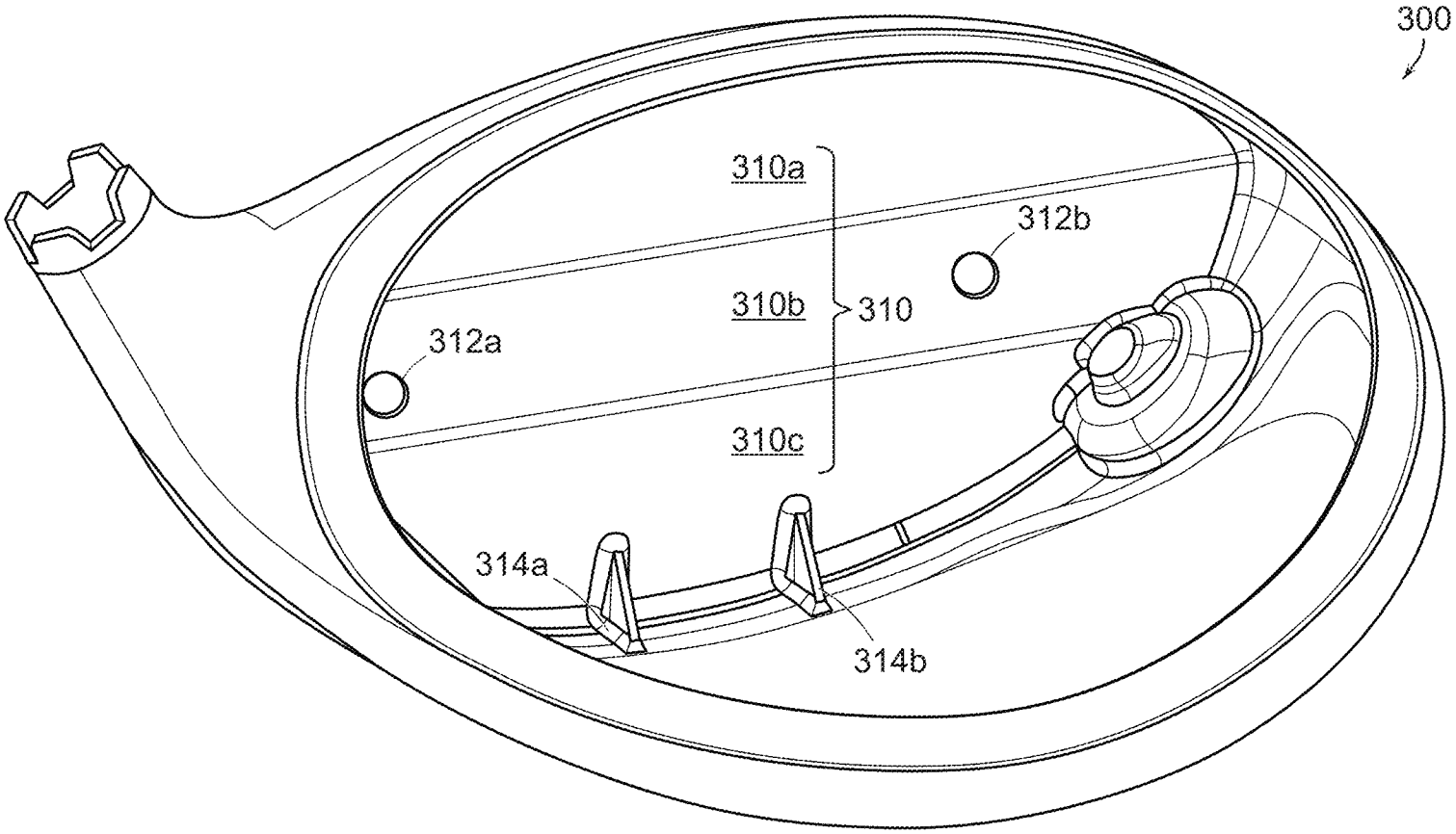
FIG. 3 of the accompanying drawings shows a partial rear perspective view of a golf club head in accordance with the present invention wherein the crown is removed to illustrate internal components.

FIG. 3 of the accompanying drawings shows a perspective view of a golf club head 300 in accordance with an alternative embodiment of the present invention wherein the crowns cover is removed. The removal of the crown cover allows the internal components of the golf club head 300 to be shown more clearly. More specifically, FIG. 3 of the accompanying drawings shows the rear weight saving chamber component of the golf club head 300. The rear weight saving chamber shown here is created by a panel member 310 that separates the frontal acoustic chamber from the rear weight saving chamber. The panel member 310 in accordance with this embodiment of the present invention may generally be multi-facetted. More specifically, the panel member 310 shown in FIG. 3 contains at least one facet or bend that separates the panel member 310 into different sub-components to further improve the acoustic signature of the golf club head 300. The faceting of the panel member 310 shown in FIG. 3 may create three different sub-panel members 310*a*, 310*b*, and 310*c*. The upper sub-panel member 310*a* may generally be connected to the crown portion of the golf club head 300; the middle sub-panel member 310*b* may generally be connected to the bottom of the upper sub-panel member 310*a*; and the bottom sub-panel member 310*c* may generally be connected to the bottom of the middle sub-panel member 310*b* and also connected to the sole portion of the golf club head 300.

In addition to illustrating the panel member 310, FIG. 3 of the accompanying drawing providing a cut open view of golf club head 300 also illustrates a plurality of circular pressure release holes 312*a* and 312*b* located in the middle sub-panel member 310*b* of the panel member 310. The plurality of two or more pressure release holes 312*a* and 312*b* allows pressure built up in the frontal acoustic chamber during impact with a golf ball to travel towards the rear weight saving chamber to minimize any undesirable acoustic effects whenever the design of the golf club head 300 necessitates their utilization. In this exemplary embodiment of the present invention, the plurality of pressure release holes 312*a* and 312*b* may have an opening area of between about 15 mm to about 25 mm, more preferably between about 17 mm and about 23 mm, and most preferably about 20 mm. It should be noted here that although the present embodiment shows a plurality of two pressure release holes 312*a* and 312*b*, the present invention can incorporate only one pressure release hole 312, or more than two pressure release hole 312 without departing from the scope and content of the present invention. Moreover, although the present embodiment of the present invention shows that the pressure release holes 312*a* and 312*b* are located in the middle sub-panel member 310*b*, they can be located at other portions of the panel member 310 to achieve similar goals without departing from the scope and content of the present invention. In fact, in alternative embodiments of the present invention, the golf club head 300 could be constructed without any pressure release holes 312*a* and 312*b* without departing from the scope and content of the present invention. (See FIG. 7)

Finally FIG. 3 of the accompanying drawings also shows a plurality of ribs 314*a* and 314*b*, that connect to the bottom sub-panel member 310*c* and the sole to provide structural rigidity to the panel member 310 to further tune the acoustic signature of the golf club head 300 without departing from the scope and content of the present invention. It should be noted that although FIG. 3 shows two ribs 314*a* and 314*b*, the present invention only incorporates the ribs 314*a* and 314*b* when the acoustic signature of the golf club head 300 needs further tuning. In fact, in alternative embodiments of the present invention, one rib, three ribs, or any multiple ribs may be used as necessary without departing from the scope and content of the present invention. In fact, in extreme situations, the current design may not incorporate any ribs at all. (See FIG. 6)

Figure 4:
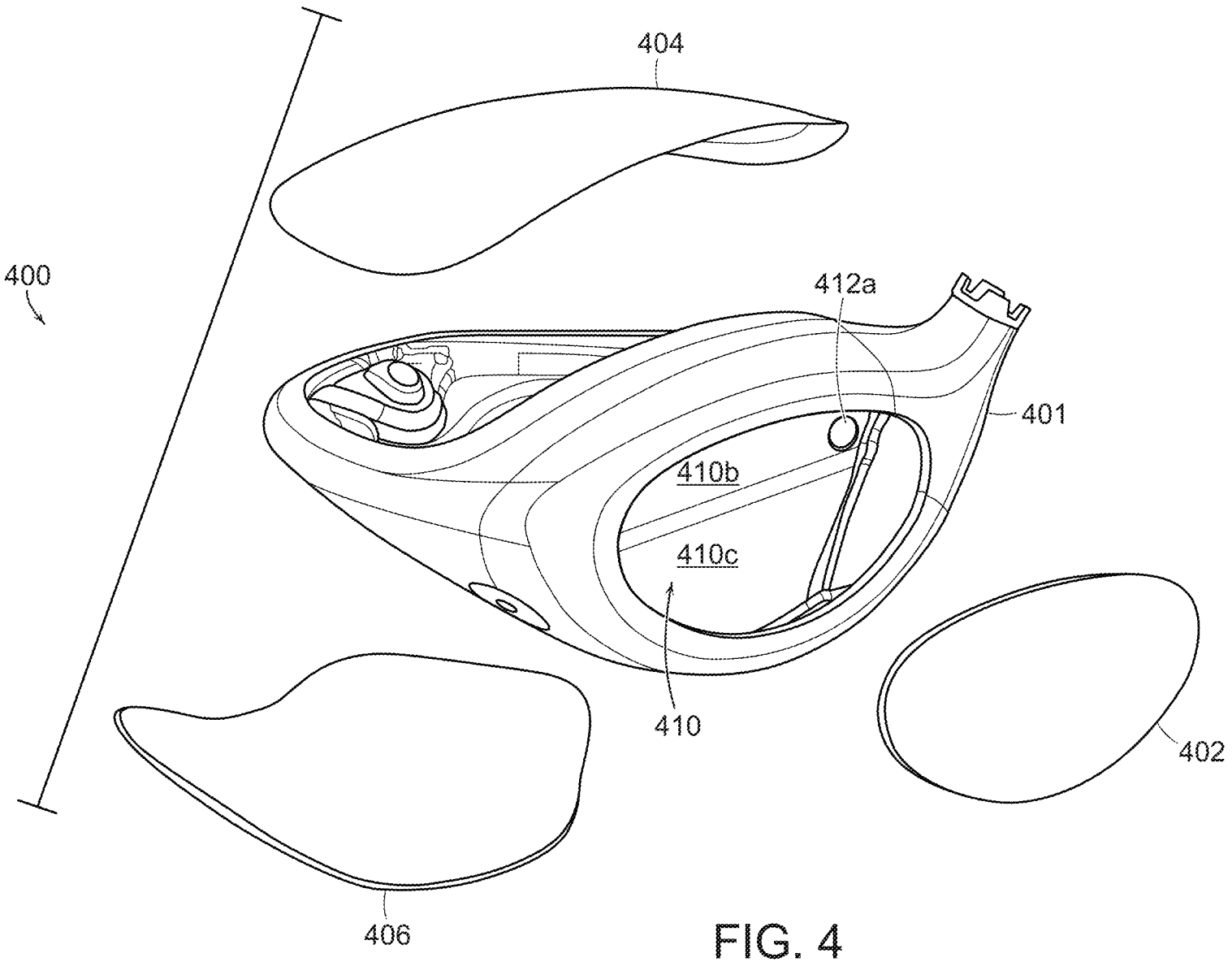
FIG. 4 of the accompanying drawings shows an exploded perspective view of a golf club head in accordance with the present invention.

FIG. 4 of the accompanying drawings shows an exploded view of a golf club head 400 in accordance with an embodiment of the present invention. The exploded view of the golf club head 400 shown here in FIG. 4 allows the relationship between the various components to be shown more clearly. More specifically, FIG. 4 introduces the ability of the sole 406 of the golf club head to be detachable from the chassis 401 of the golf club head 400. The sole 406 works in conjunction with the crown 404 to create the rear weight saving chamber previously discussed, which once again, is separated from the frontal acoustic chamber via a panel member 410. This exploded frontal view with the striking face 402 removed, allows the frontal acoustic chamber to be shown more clearly, and the frontal view of the panel member 410 to be shown as well. Similar to the discussion above, the panel member 410 may be further divided into an upper sub-panel member (not shown in FIG. 4), a middle sub-panel member 410*b*, and a lower sub-panel member 410*c*, all while incorporating the same pressure release hole 412*a* and 412*b* (not shown in FIG. 4).

Figure 5:
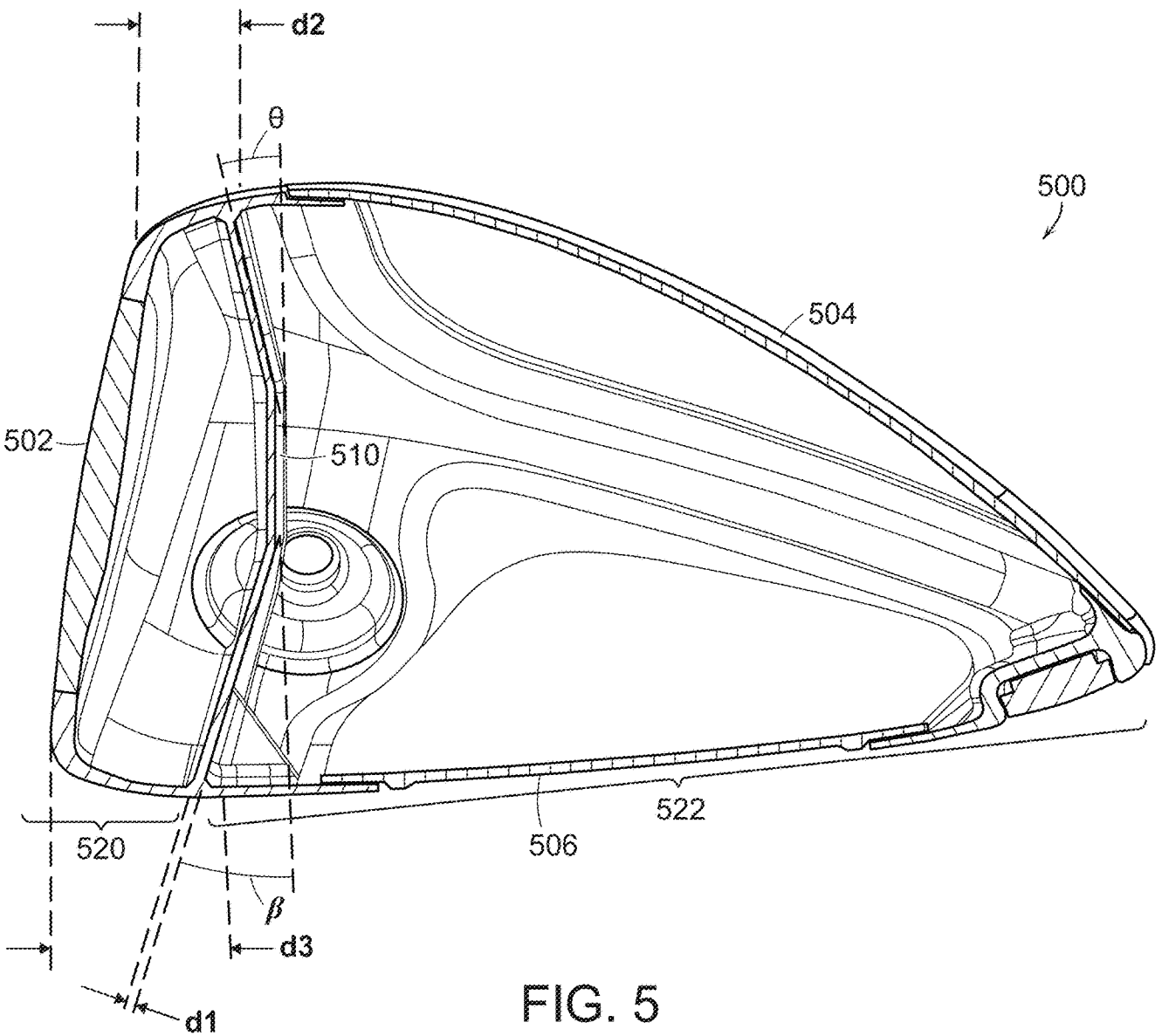
FIG. 5 of the accompanying drawings shows a cross-sectional view of a golf club head in accordance with the present invention.

In order for the relationship between the frontal acoustic chamber and the rear weight saving chamber to be shown more clearly, a cross-sectional view of the golf club head 400 may be more helpful. FIG. 5 of the accompanying drawings does exactly this by providing a cross-sectional view of a golf club head 500 in accordance with an exemplary embodiment of the present invention. Although previous discussion has hinted at the existence of a frontal acoustic chamber 520 and a rear weight saving chamber 522 within the internals of the golf club head 500, the cross sectional view of the golf club head 500 identifies the here as frontal acoustic chamber 520 and rear weight saving chamber 522, which are separated and bifurcates the golf club via a panel member 510. The frontal acoustic chamber 520 shown here is comprised out of a frontal portion of a chassis of the golf club head 500 as well as the striking face 502 insert. The rear weight saving chamber 522 may generally be comprised of at least one composite panel that helps achieve the weight saving goals of the golf club head 500. The word "composite" as used in this application may refer to the general term of any material that has two or more different materials combined together, however, in a preferred embodiment of the present invention, fiber reinforced plastic is the general material. In this specific embodiment shown in FIG. 5, the golf club head 500 incorporates two composite panels by incorporating a lightweight composite crown 504 and a lightweight composite sole 506 to maximize the weight savings; however, in alternative embodiments either one of the pieces may be used exclusively without the other component without departing from the scope and content of the present invention.

The cross-sectional view of the golf club head 500 shown in FIG. 5, in addition to showing the relationship between the frontal acoustic chamber 520 and the rear weight saving chamber 522, also provides a perspective on their relative volumes to one another to create a very critical volume ratio. First and foremost, this cross-sectional view, is taken along a plane that runs front and back through the golf club head, taken down the center through the center of the face. The golf club head 500 may generally have a Front to Rear Volume Ratio of less than about 0.50, more preferably less than about 0.40, and most preferably less than about 0.35; wherein the Front to Rear Volume Ratio is defined by Equation (1) below:

$$\text{Front to Rear Volume Ratio} = \frac{\text{Volume of Frontal Acoustic Chamber 520}}{\text{Volume of Rear Weight Saving Chamber 522}} \quad \text{Eq. (1)}$$

More specifically, the frontal acoustic chamber 520 may generally have a volume of less than about 230 cc, more preferably less than about 150 cc, and most preferably less than about 100 cc; while the rear weight saving chamber 522 may have a volume of greater than about 230 cc, more preferably greater than about 310 cc, and most preferably greater than about 360 cc.

In order to create the Front to Rear Volume Ratio identified above, the panel member 510 shown in this embodiment may generally have a thickness d1 of between about 0.1 mm to about 2.0 mm, more preferably between about 0.25 mm to about 1.0 mm, and most preferably about 0.5 mm. The thickness of the panel member 510 is important and critical to the proper functioning of the golf club head 500, as it creates the necessary barrier between the frontal acoustic chamber 520 and the rear weight saving chamber 522. If the thickness d1 of the panel member 510 is too thick, then the correlation between the vibration of the frontal acoustic chamber 520 and the rear weight saving chamber 522 might no longer be synchronized, eliminating the efficiency of the frontal acoustic chamber 520. Alternatively, if the thickness d1 is too thin, then the correlation between the two chambers might be too high, allowing the acoustic signature to be over damped by the composite material used by the rear weight saving chamber 522. It should be noted here that although the thickness d1 is shown here as constant throughout the panel member 510, the thickness could be variable depending on the needs of the golf club head 500 without departing from the scope and content of the present invention.

FIG. 5 of the accompanying drawings also shows the placement of the panel member 510 relative to the frontal striking surface of the golf club head 500. In this exemplary embodiment of the present invention, the top of the panel member 510 may generally be placed at a distance d2 of between about 8 mm to about 36 mm, more preferably between about 9 mm to about 24 mm, and most preferably about 10 mm. The bottom of the panel member 510 may be placed at a distance d3 of between about 13 mm to about 51 mm, more preferably between about 14 mm to about 45 mm, and most preferably about 15 mm. It should be noted here that distance d3 here is intentionally greater than the distance d2 in order to create the acoustic characteristics desired in the frontal acoustic chamber 520. In order to achieve the acoustic signature, a specific ratio between the distance d2 of the top and the distance d3 of the bottom is maintained between about 0.45 and 0.70, more preferably between about 0.50 and about 0.60, and most preferably about 0.55; which is referred to as the Panel Offset Ratio. The Panel Offset Ratio is defined here by Equation (2) below:

$$\text{Panel Offset Ratio} = \frac{\text{Distance } d2 \text{ of crown offset from frontal plane}}{\text{Distance } d3 \text{ of sole offset from frontal plane}} \quad \text{Eq. (2)}$$

FIG. 5 of the accompanying drawings also shows a specific geometry used to create the panel member 510 wherein the tri-facetted panel member 510 create a unique geometry wherein the center of the panel member 510 is further away from the striking face 502 to increase the volume of the frontal acoustic chamber 520. Alternatively speaking, it can be said that the panel member has a unique geometry wherein the center of the panel member 510 being placed further away from the striking face 502 than at the crown 504 and sole 506 portion of the panel member 510.

FIG. 5 of the accompanying drawings also shows more detail regarding the different facets created by the panel member 510 in creating the upper sub-panel member, the middle sub-panel member, and a lower sub-panel member. More specifically, a closer look at the panel member 510 in FIG. 5 shows that the upper sub-panel member may form an angle θ with the middle sub-panel member of between about 10 degree to about 15 degrees, more preferably between about 12 degrees to about 14 degrees, and most preferably about 13 degrees. The lower sub-panel member and the middle sub-panel member form an angle β of between about 16 degrees to about 20 degrees, more preferably between about 17 degrees to about 19 degrees, and most preferably about 18 degrees. It should be noted here that similar to the intentional difference between distances d2 and d3, the difference in the angle of the upper sub-panel member and the lower sub-panel member is intentional and critical in achieving the desired acoustic signature of the golf club head 500 as it alters the angle of the panel.

Finally, FIG. 5 shows a different attachment methodology for the crown 504 composite panel and the sole 506 composite panel, as it relates to the chassis of the golf club head 500. In this embodiment of the present invention, the crown 504 composite panel may generally be attached externally to the golf club head 500 via recesses created in the club head 500, wherein the sole 506 composite panel is attached internally to the golf club head 500 via the opening created in the crown 504 section. This combination of different attachment mechanisms is beneficial to the current invention because it allows different unique constructions that would previously be difficult to achieve. In one example, the internal attachment of the sole 506 composite piece would allow an internal rib to be added wherein such an internal rib would not be physically possible if the attachment was external. Although the present invention shows the crown 504 composite piece being external and the sole 506 composite piece being internal, the two attachment methodologies could be reversed with the crown piece 504 being installed internally without departing from the scope and content of the present invention.

Figure 6:
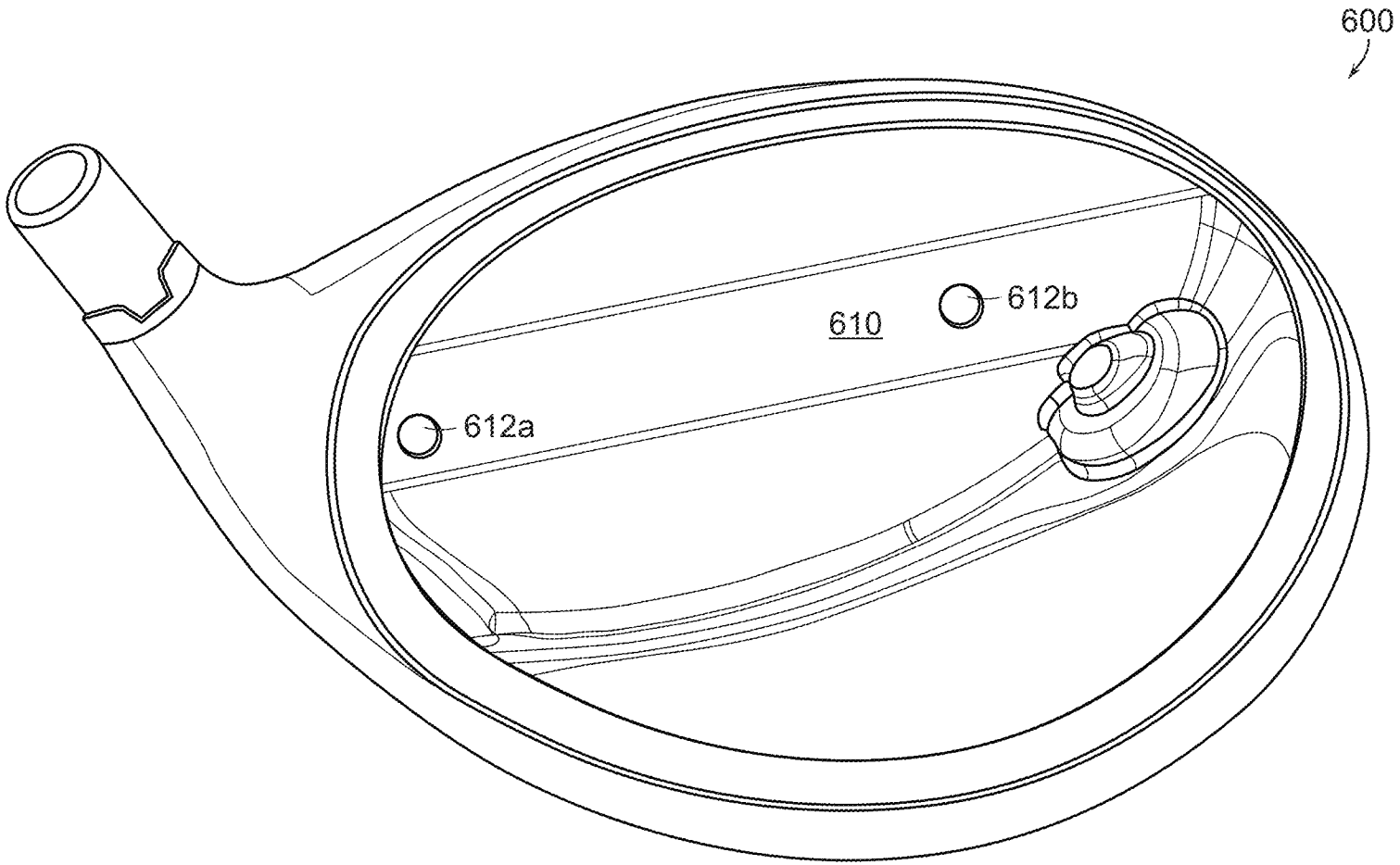
FIG. 6 of the accompanying drawings shows a partial rear perspective view of a golf club head in accordance with an alternative embodiment of the present invention.

FIG. 6 of the accompanying drawings shows a golf club head 600 in accordance with an alternative embodiment of the present invention wherein the panel member 610 does not need any ribs. This alternative embodiment still incorporates a facetted panel member 610 that separates the panel member 610 in to three separate sub-components, and still utilizes pressure release holes 612*a* and 612*b* to achieve the acoustic properties desired. It should be noted that the necessity and placement of the ribs and pressure releases holes 612*a* and 612*b* may generally depend on the shape, contour, and choice of materials of the golf club head 600 and the acoustic signatures that it generates, and either of these components may exist independent of one another without departing from the scope and content of the present invention. In this current embodiment shown in FIG. 6, the golf club head 600 may exhibit sufficient structural stiffness in the panel member 610 in the bottom, but the acoustic attenuation within the frontal acoustic chamber builds up too much pressure and requires a relief via the pressure release holes 612*a* and 612*b*.

Figure 7:
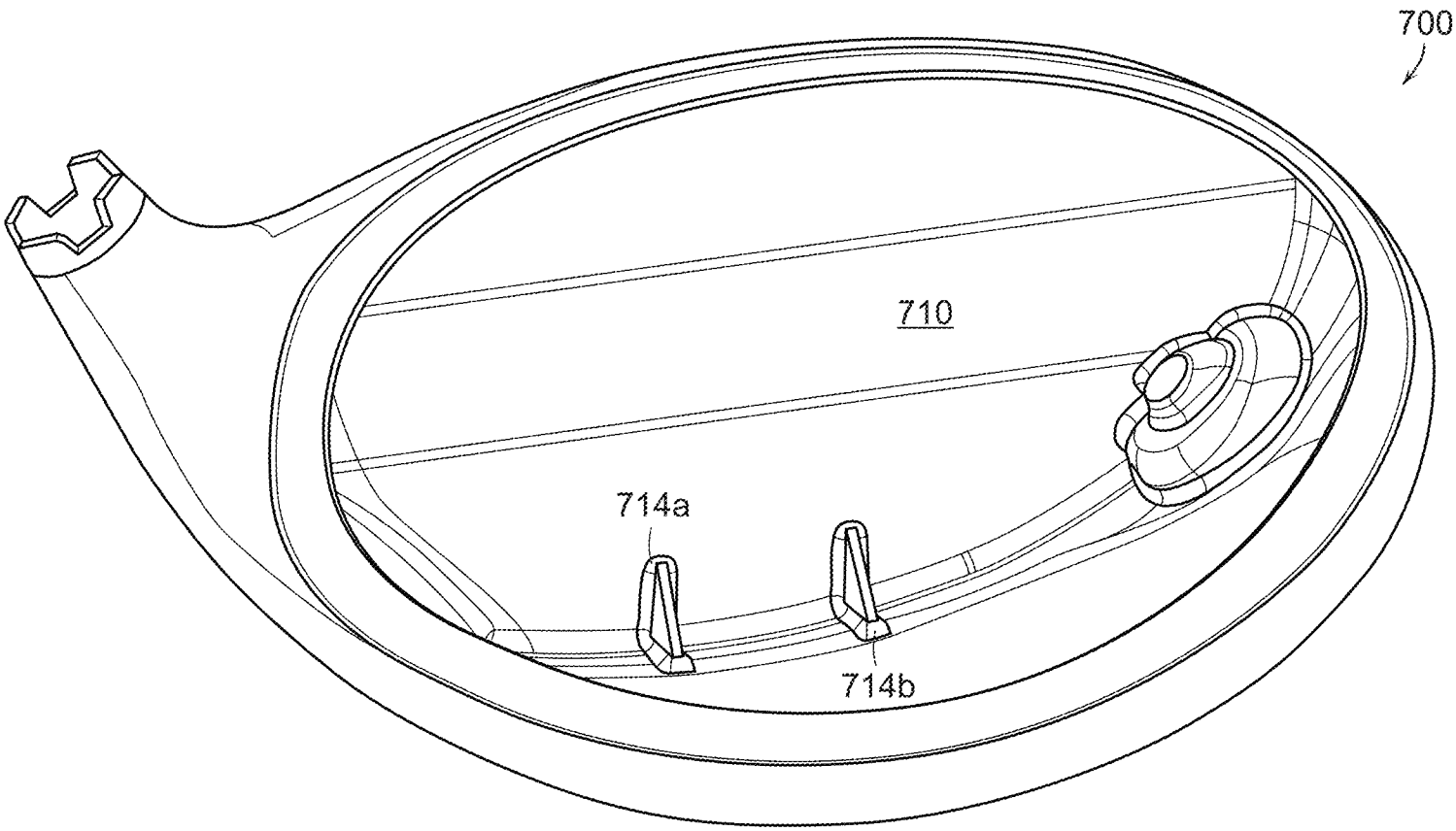
FIG. 7 of the accompanying drawings shows a partial rear perspective view of a golf club head in accordance with an alternative embodiment of the present invention.

In fact, FIG. 7 of the accompanying drawings shows exactly one of the alternative embodiments of the present invention wherein the golf club head 700 incorporates a plurality of ribs 714*a* and 714*b* without the need for pressure release holes. This embodiment may be preferred when the acoustic signature of the golf club head is undesirable due to the lack of stiffness in the bottom portion of the panel member 710.

Figure 8:
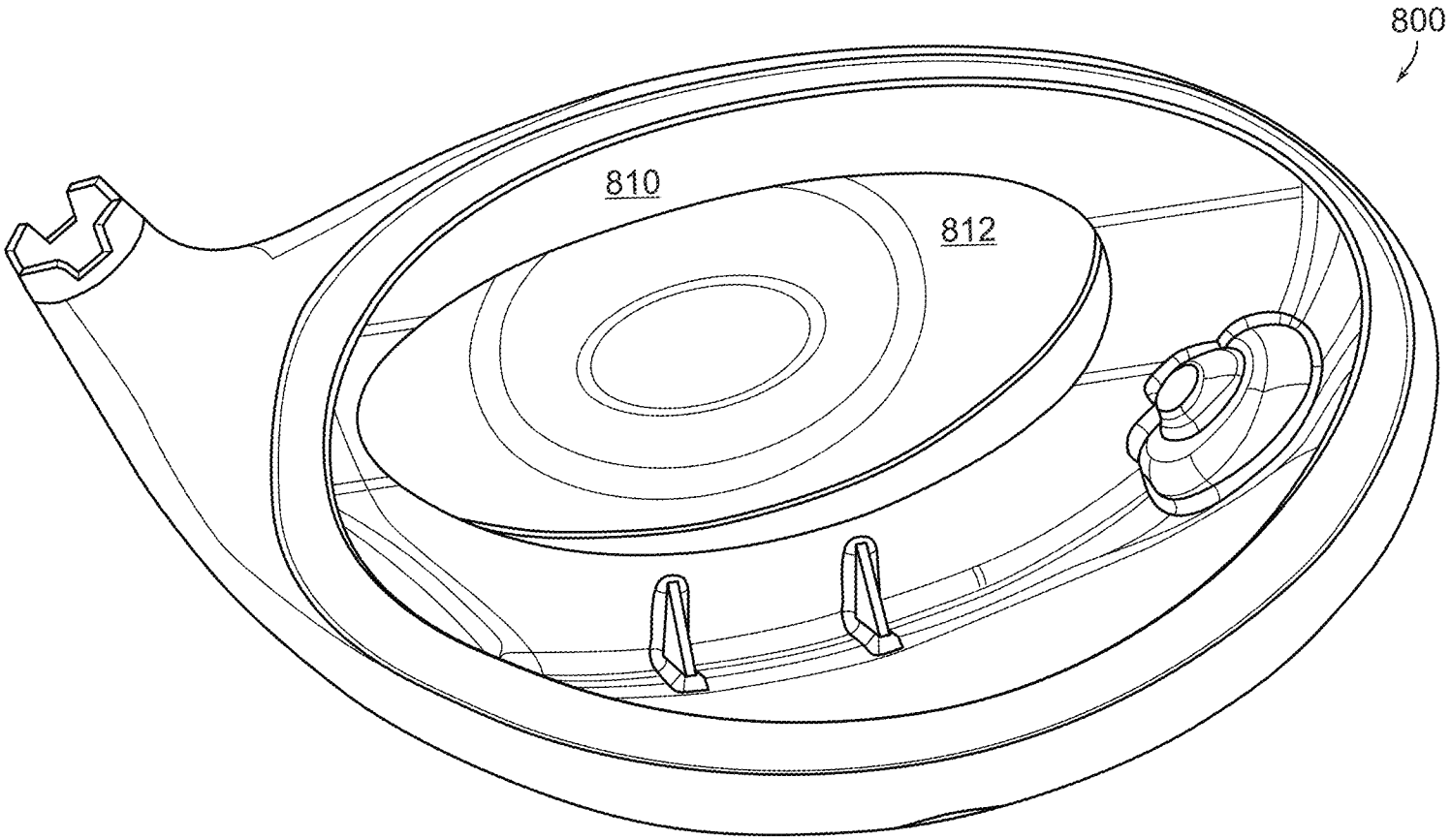
FIG. 8 of the accompanying drawings shows a partial rear perspective view of a golf club head in accordance with an even further alternative embodiment of the present invention.

FIG. 8 of the accompanying drawings shows a golf club head 800 in accordance with an alternative embodiment of the present invention wherein the panel member 810 that separates the frontal acoustic chamber and the rear weight saving chamber may be comprised out of one oversized pressure release hole 812 to help achieve differing acoustic frequencies that may be required for the golf club head 800. In this embodiment of the present invention, the area of the oversized pressure release hole 812 may generally be greater than about 2,000 $mm^2$, more preferably greater than about 2,200 $mm^2$, and most preferably greater than about 2,400 $mm^2$. The oversized pressure release hole 812 may be desired in situations wherein the acoustic properties of the golf club head 800 require such a design.

Figure 9:
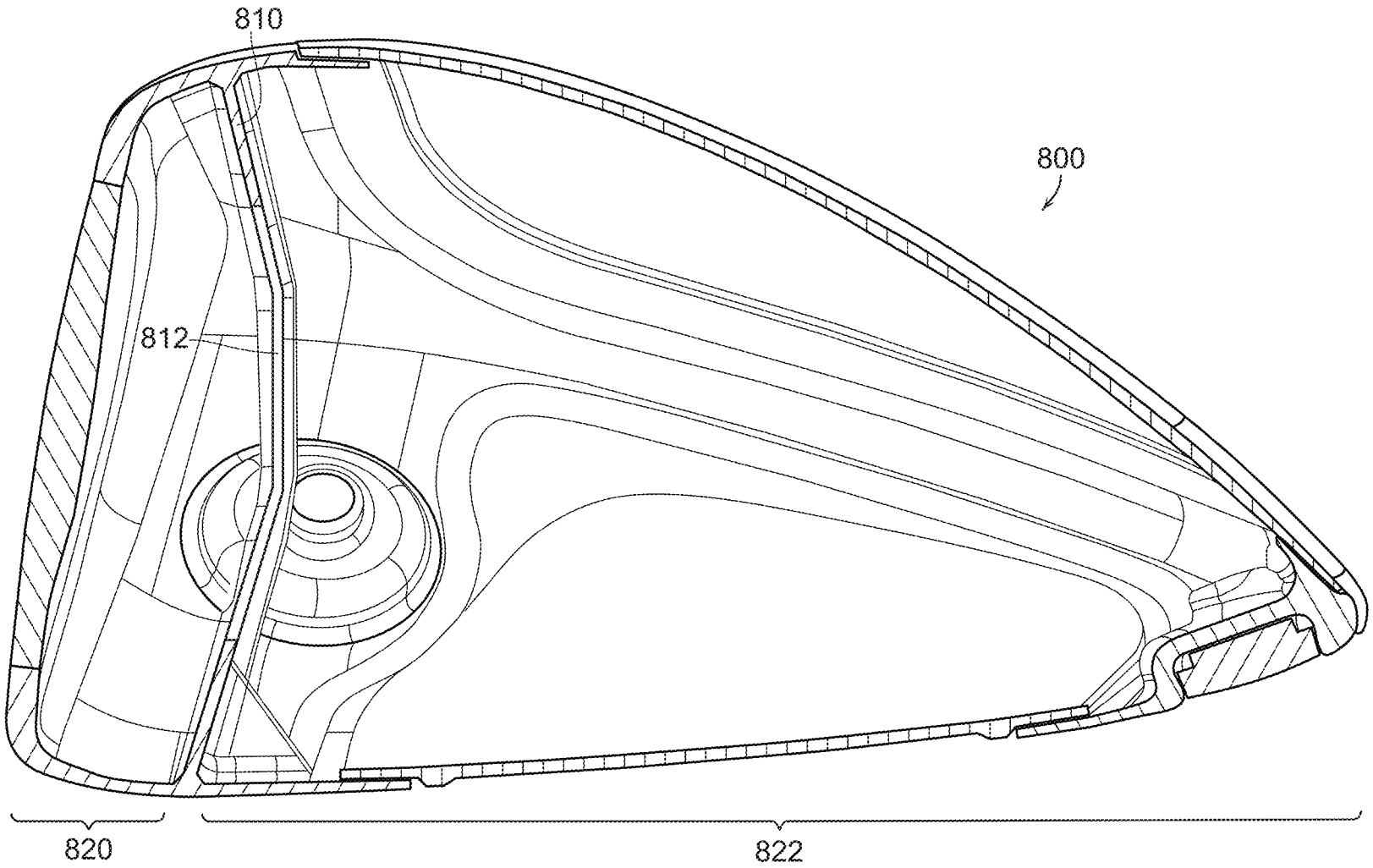
FIG. 9 of the accompanying drawings shows a cross-sectional view of a golf club head in accordance with a further alternative embodiment of the present invention.

In order to illustrate the relationship between the frontal acoustic chamber and the rear weight saving chamber in this alternative embodiment of the present invention, FIG. 9 is provided here showing a cross-sectional view of a golf club head 800 in accordance with an alternative embodiment of the present invention. In this cross-sectional view, it can be seen that the oversized pressure release hole 812 provides a large connection between the frontal acoustic chamber 820 and the rear weight saving chamber 822 not only for the acoustic properties as previously mentioned, but can also provide additional weight savings from the panel member 810 as well.

Figure 10:
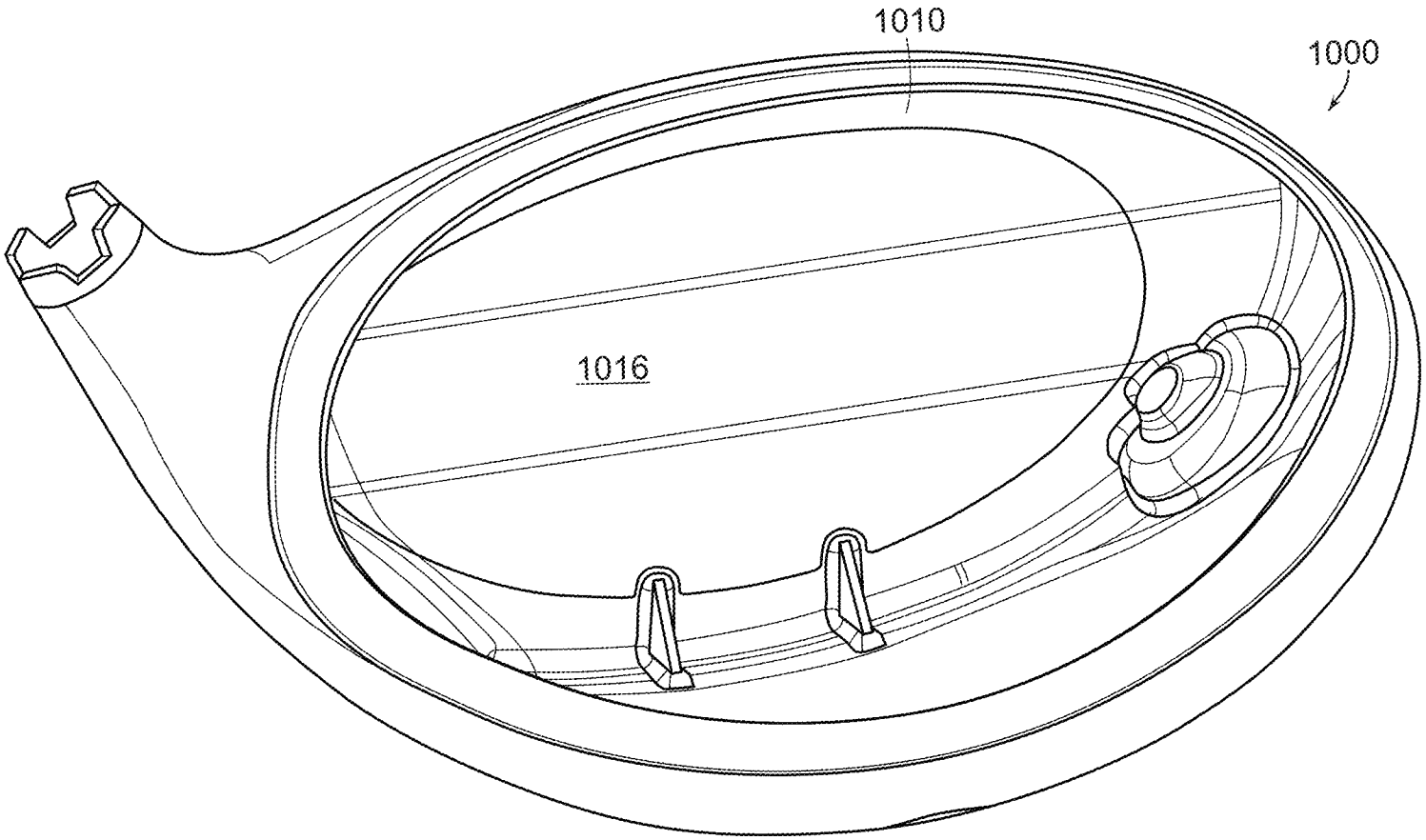
FIG. 10 of the accompanying drawings shows a partial rear perspective view of a golf club head in accordance with an alternative embodiment of the present invention.
Figure 11:
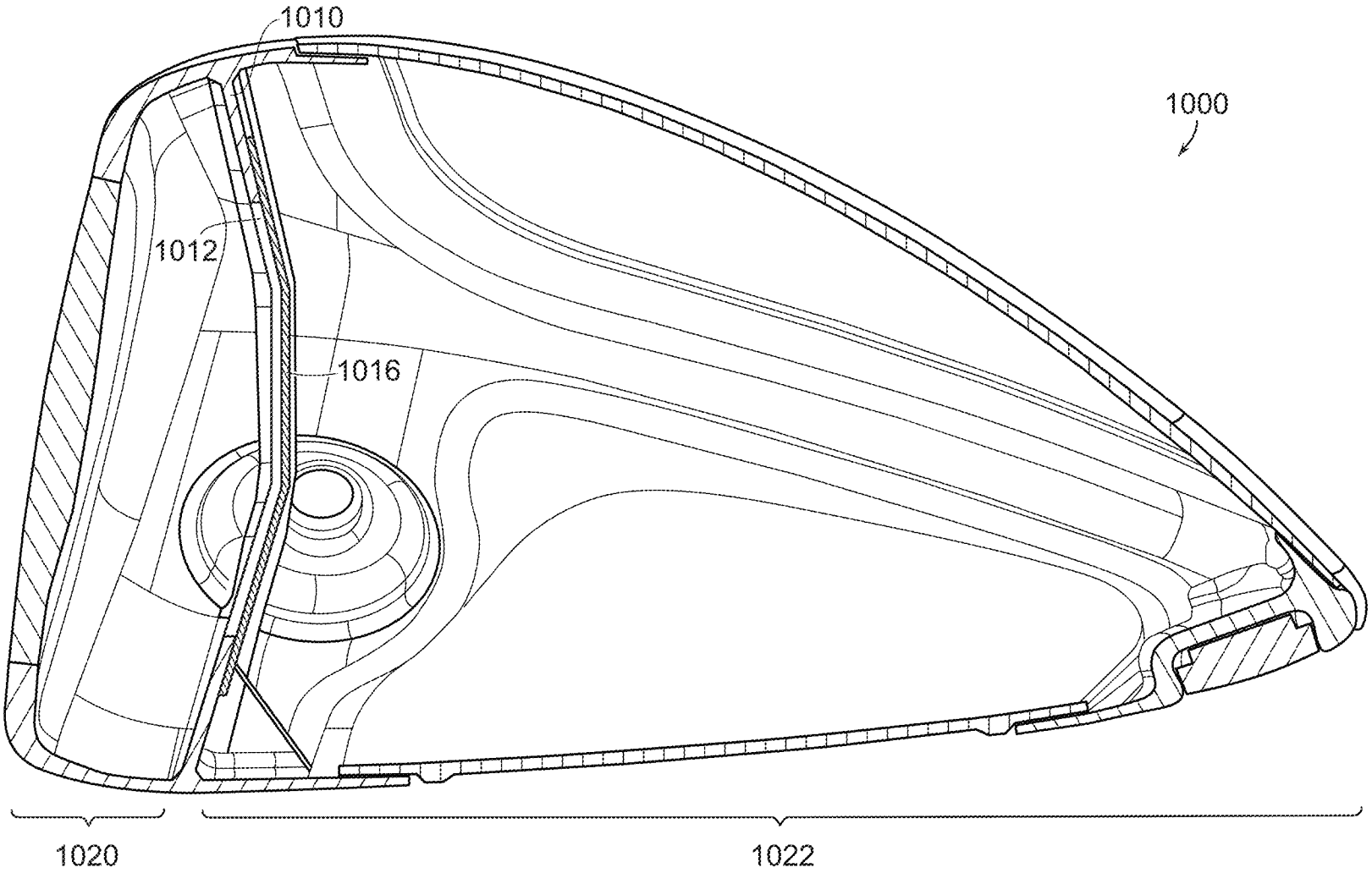
FIG. 11 of the accompanying drawings shows a cross-sectional view of a golf club head in accordance with an alternative embodiment of the present invention.

FIGS. 10 and 11 provide a rear opened view and a cross-sectional view of golf club heads 1000 in accordance with an alternative embodiment of the present invention wherein the oversized pressure release hole 1012 that is created on the panel member 1010 can be covered up by a lightweight panel 1016 to regain some of the acoustic characteristic and provide more separation between the frontal acoustic chamber 1020 and the rear weight saving chamber 1022. The lightweight panel 1016 may be attached using different means of attachment such as gluing, screwing, swaging, just to name a few. One thing to recognize is that because the placement of the lightweight panel 1016 is away from the frontal contact region, the stresses of impact are smaller, allowing more simplistic attachment means to be used.

Figure 12:
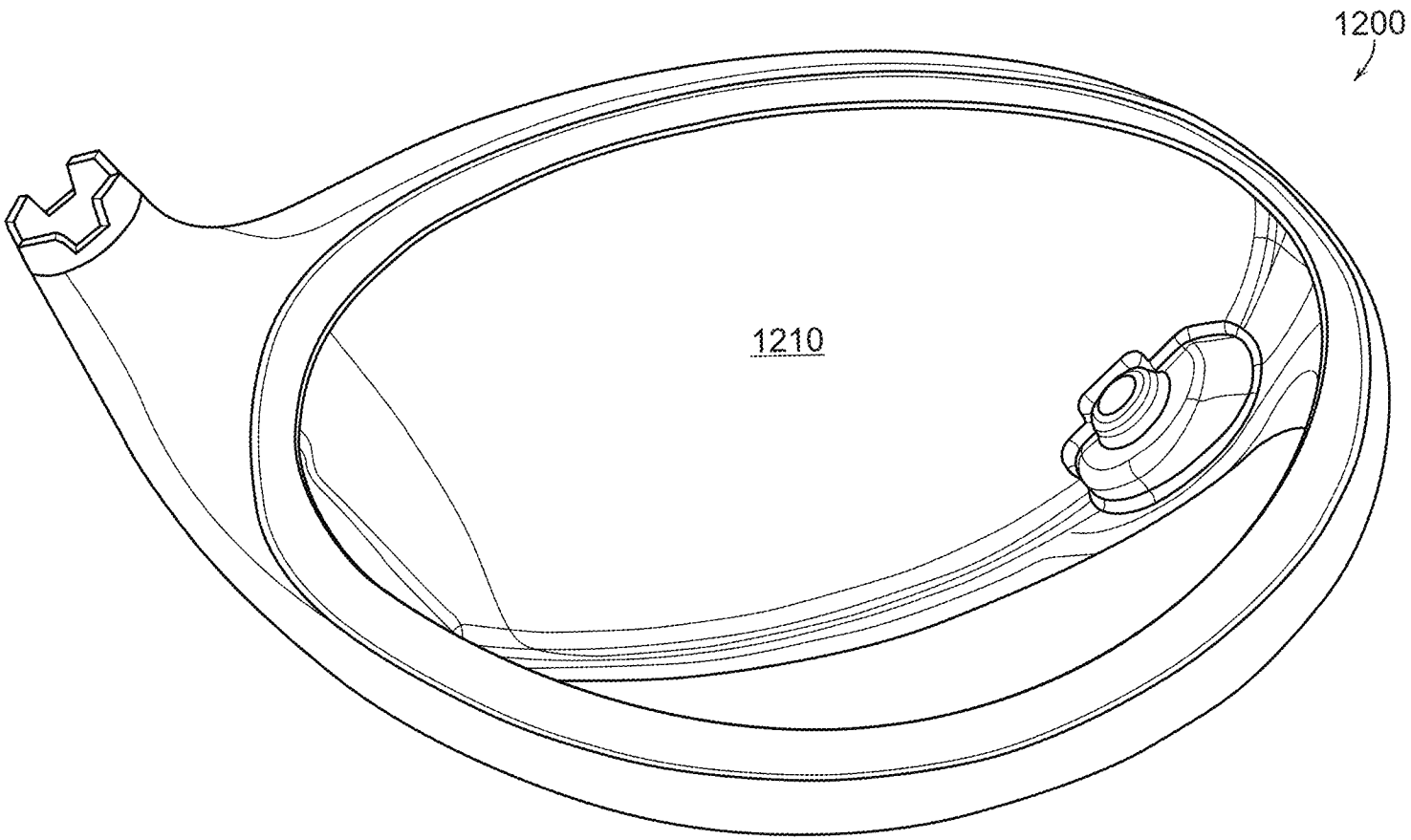
FIG. 12 of the accompanying drawings shows a partial rear perspective view of a golf club head in accordance with another alternative embodiment of the present invention.
Figure 13:
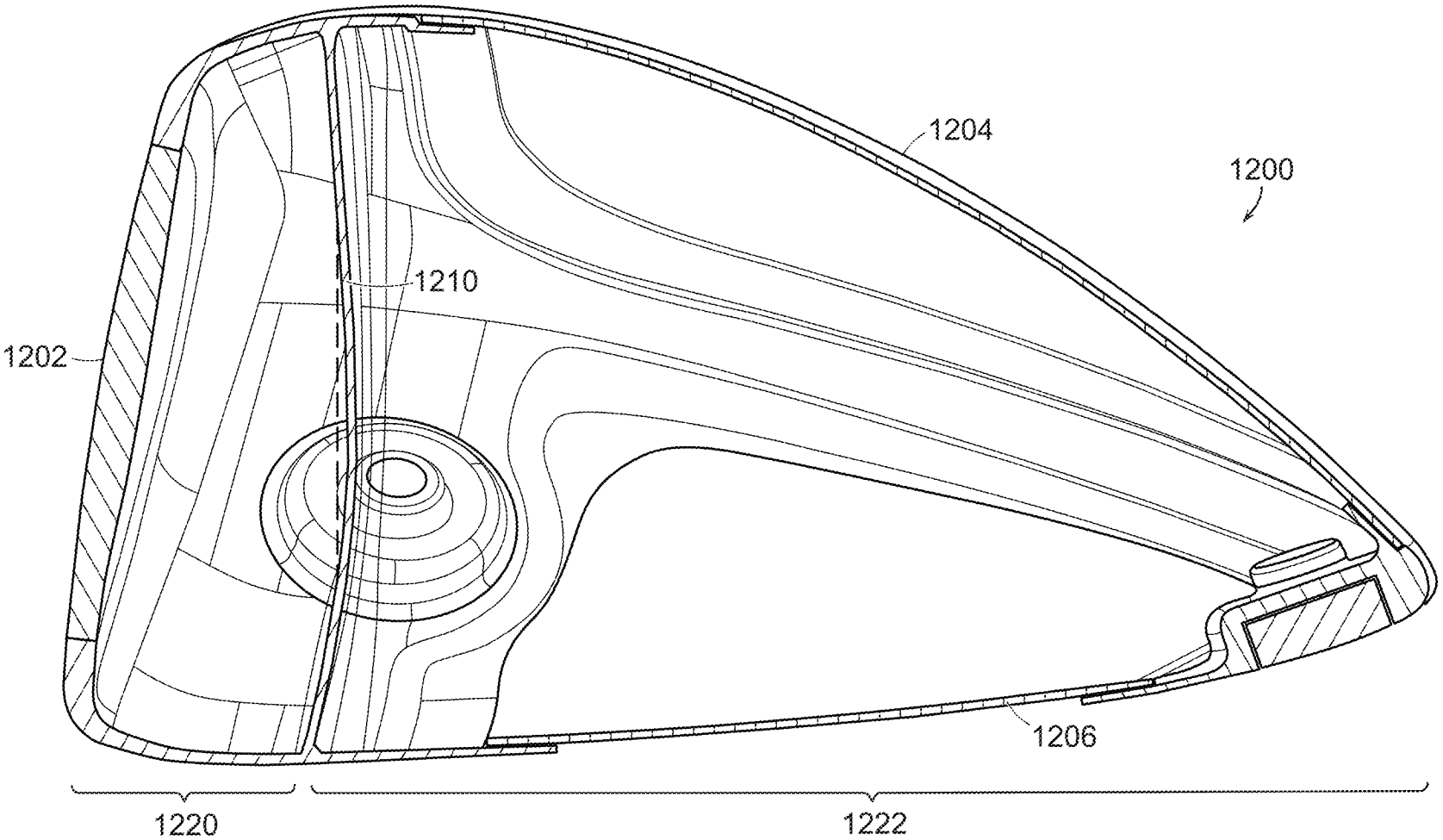
FIG. 13 of the accompanying drawings shows a cross-sectional view of a golf club head in accordance with another alternative embodiment of the present invention.

FIGS. 12 and 13 provide a rear opened view and a cross-sectional view of a golf club head 1200 in accordance with an alternative embodiment of the present invention wherein the panel member 1210 may take on a slightly different shape than previous embodiments. More specifically, FIGS. 12 and 13 show a golf club head 1200 wherein the panel member 1210 is curved away from the frontal portion of the golf club head 1200 instead of being facetted into three different zones as shown in previous embodiments. Alternatively it can be said that the shape of the panel member 1210 is continuously curved with the center of the panel member 1210 being placed further away from the striking face 1202 than at the crown 1204 and sole 1206 portion of the panel member 1210. Having a panel member 1210 that contains a continuous curvature is beneficial in certain embodiments wherein the acoustic signature of the frontal acoustic chamber 1220 requires more vibration, wherein the convergence points of the previous design would disrupts this vibration. In addition, the rear weight savings chamber 1222 may also benefit by minimizing the volume within that chamber. It should be noted although this embodiment of the present invention shown in FIGS. 12 and 13 does not incorporate any ribs or pressure release holes, they can be incorporated into this design depending on the acoustic needs of the golf club head 1200 without departing from the scope and content of the present invention.

Figure 14:
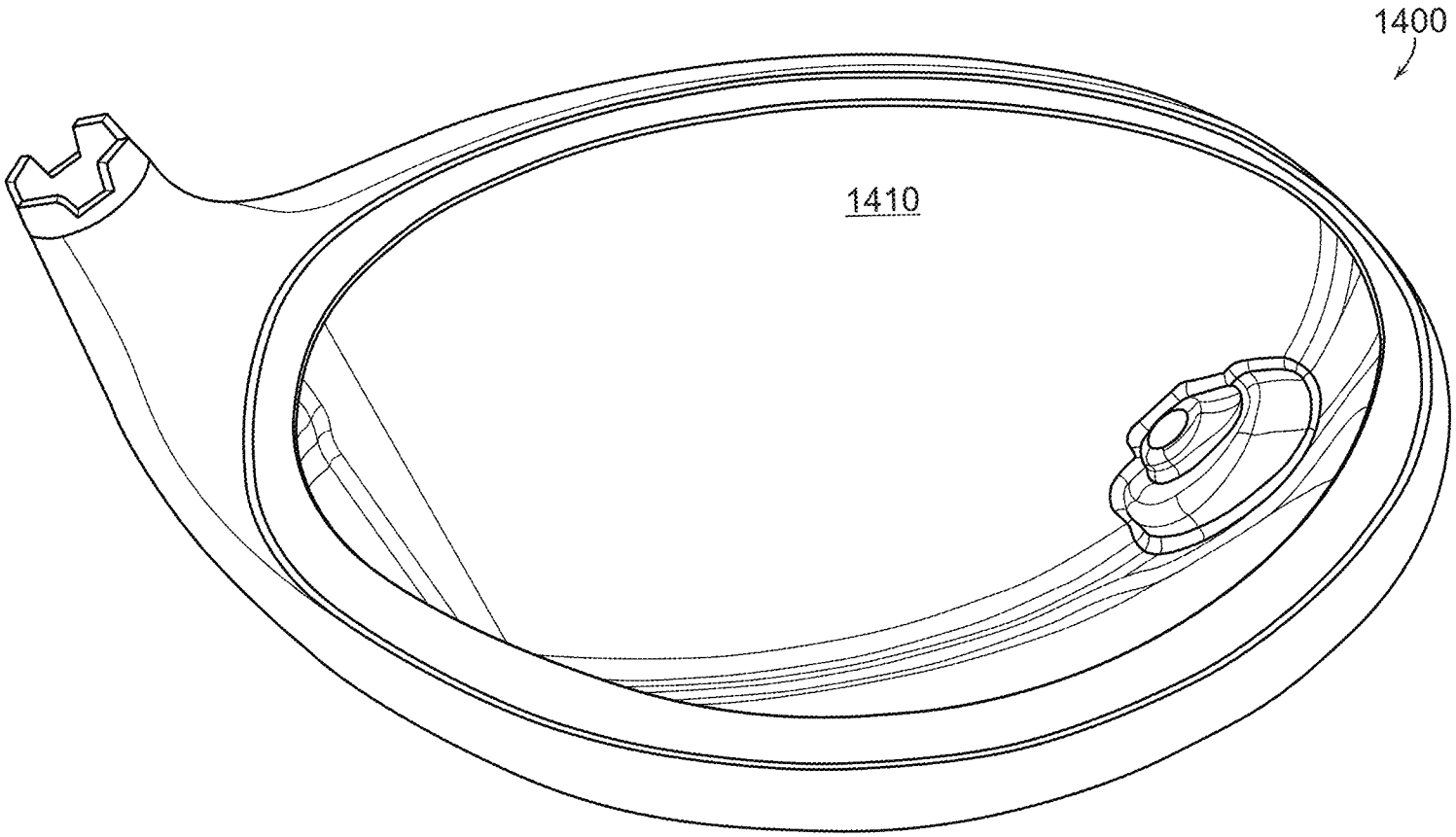
FIG. 14 of the accompanying drawings shows a partial rear perspective view of a golf club head in accordance with another alternative embodiment of the present invention.
Figure 15:
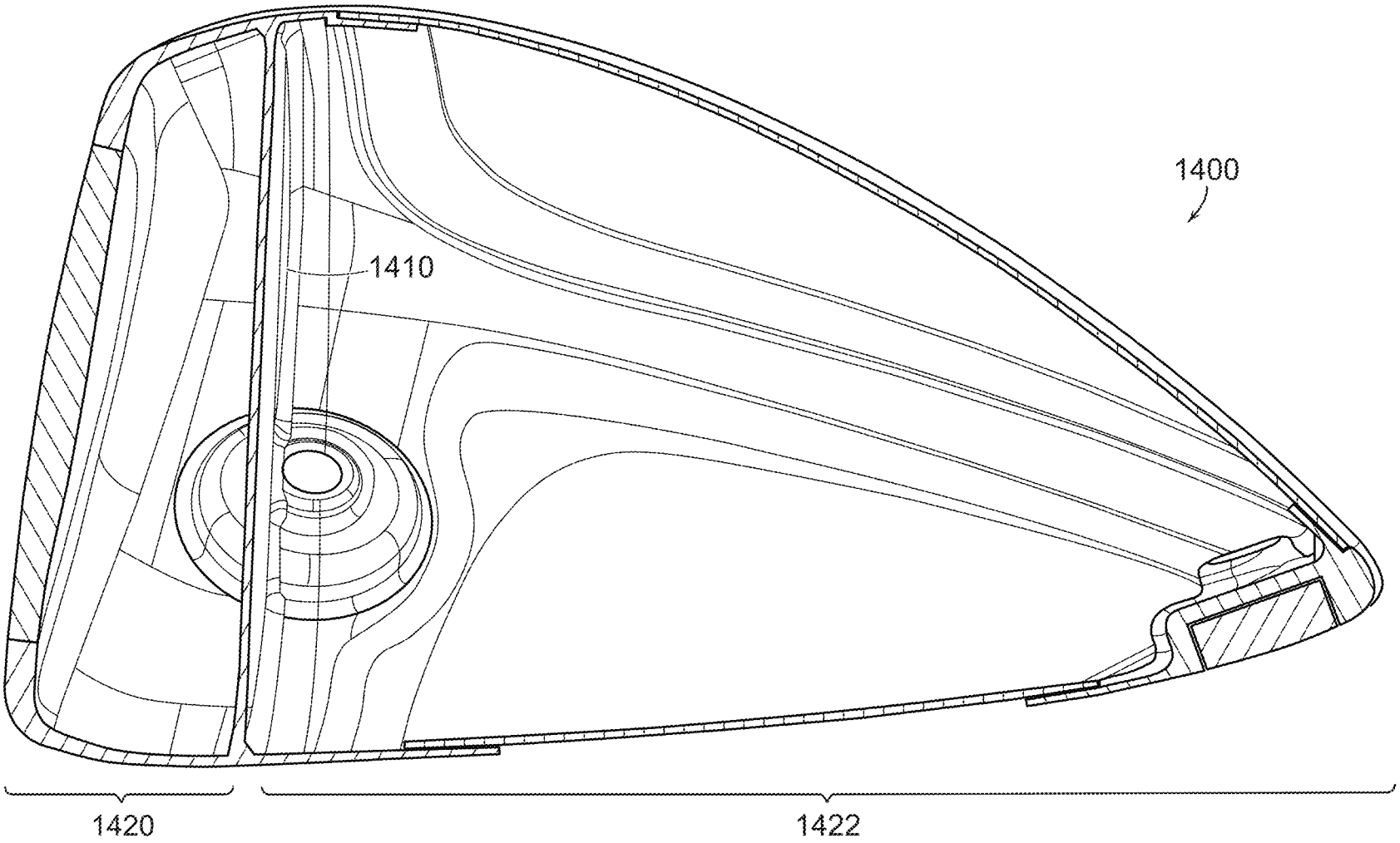
FIG. 15 of the accompanying drawings shows a cross-sectional view of a golf club head in accordance with another alternative embodiment of the present invention.

FIGS. 14 and 15 provides a rear opened view and a cross-sectional view of a golf club head 1400 in accordance with an even further alternative embodiment of the present invention wherein the panel member 1410 is a complete vertical wall. Having the panel member in the shape of a completely vertical wall is generally less desirable in creating the appropriate acoustic signature in the frontal acoustic chamber 1420, as a completely vertical panel member 1410 can hinder the ability of the golf club head 1400 to generate the vibration needed to achieve a desirable sound. Conversely, the rear weight saving chamber 1422 is adjusted accordingly. However, in extreme situations wherein the profile of the golf club head 1400 requires such a design, this alternative embodiment of the present invention will provide a golf club head 1400 that can achieve the acoustic signature required.

Figure 16:
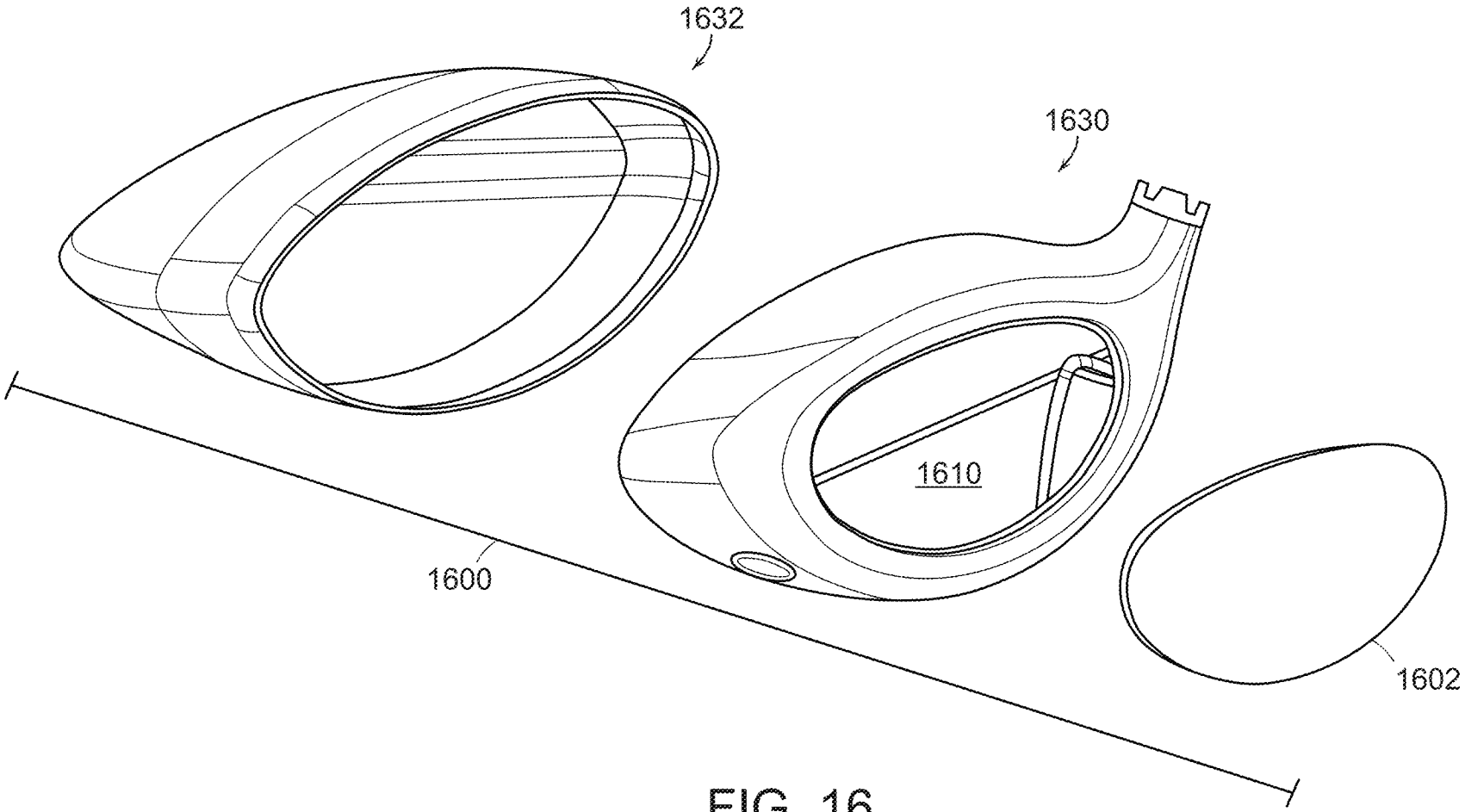
FIG. 16 of the accompanying drawings shows an exploded perspective of a golf club head in accordance with an even further alternative embodiment of the present invention.
Figure 17:
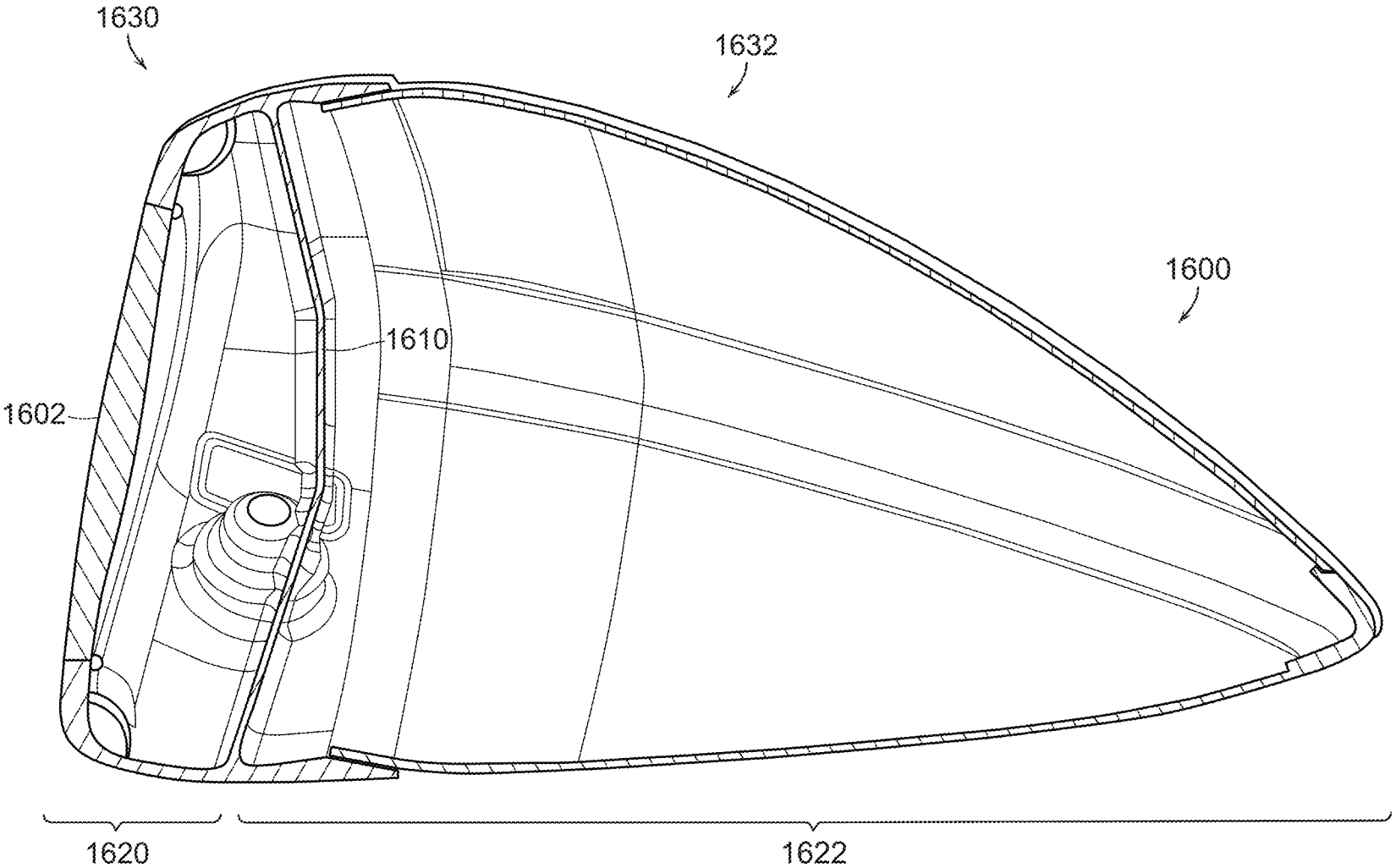
FIG. 17 of the accompanying drawings shows a cross-sectional view of a golf club head in accordance with an even further alternative embodiment of the present invention.

FIGS. 16 and 17 provide an exploded perspective view and a cross-sectional view of a golf club head 1600 in accordance with an even further alternative embodiment of the present invention. In this alternative embodiment of the present invention, the golf club head 1600 is separated into two separate components, a forward metallic portion 1630 and an aft composite portion 1632. It should be noted that the forward metallic portion 1630 and the aft composite portion 1632 refer to the external physical components that make up the golf club head 1600, while the frontal acoustic chamber 1620 and the rear weight saving chamber 1622 refer to internal components within the golf club head 1600. In this embodiment of the present invention, the external physical components of the golf club head 1600 are a striking face 1602, a forward metallic portion 1630 having a frontal opening and forming a panel member 1610, and an aft composite portion 1632. The exploded view of the golf club head 1600 shown in FIG. 16, especially when compared to the exploded view of the golf club head 400 (shown in FIG. 4) demonstrate the difference between the two embodiments of the present invention. More specifically, it can be seen here that the present embodiment shown in FIG. 16 completely removes any metallic components from the rear portion of the golf club head 1600, utilizing a completely composite material at the back half of the golf club head 1600 to further achieve weight savings.

In order to illustrate the relationship between the external physical components and the internal components, FIG. 17 is provided with a cross-sectional view of the golf club head 1600. In this cross-sectional view of the golf club head 1600, it can be seen that the frontal acoustic chamber 1620, similar to all previous embodiments, is completely formed by the forward metallic portion 1630. However, the aft composite portion 1632 shown in this cross-sectional view illustrates that the entirety of the back of the golf club head 1600 is made out of a composite material, making the frontal acoustic chamber 1620 even more important in creating the proper acoustic signature. In this embodiment of the present invention, the aft composite portion 1632 is joined to the forward metallic portion 1630 via a lap joint wherein the aft composite portion 1632 is underneath the forward metallic portion 1630. This type of unique construction of putting the composite material underneath the metallic material can be beneficial to the performance of the golf club head 1600, as it lends itself well to the utilization of internal ribs to provide structural rigidity to a composite material that tends to need such a support. However, it should be noted here that although the golf club head shown in this embodiment of the present invention shows a lap joint, numerous other types of joints may be used as long as it is capable of connecting the forward metallic portion 1630 and the aft composite portion 1632 without departing from the scope and content of the present invention.

A lot of the aforementioned discussion relates to the utilization of the frontal acoustic chamber to create a desirable acoustic signature for a golf club head using different designs and embodiments. Hence, this invention would be remiss if it did not provide more information regarding what acoustic signature it achieves.

Figure 18:
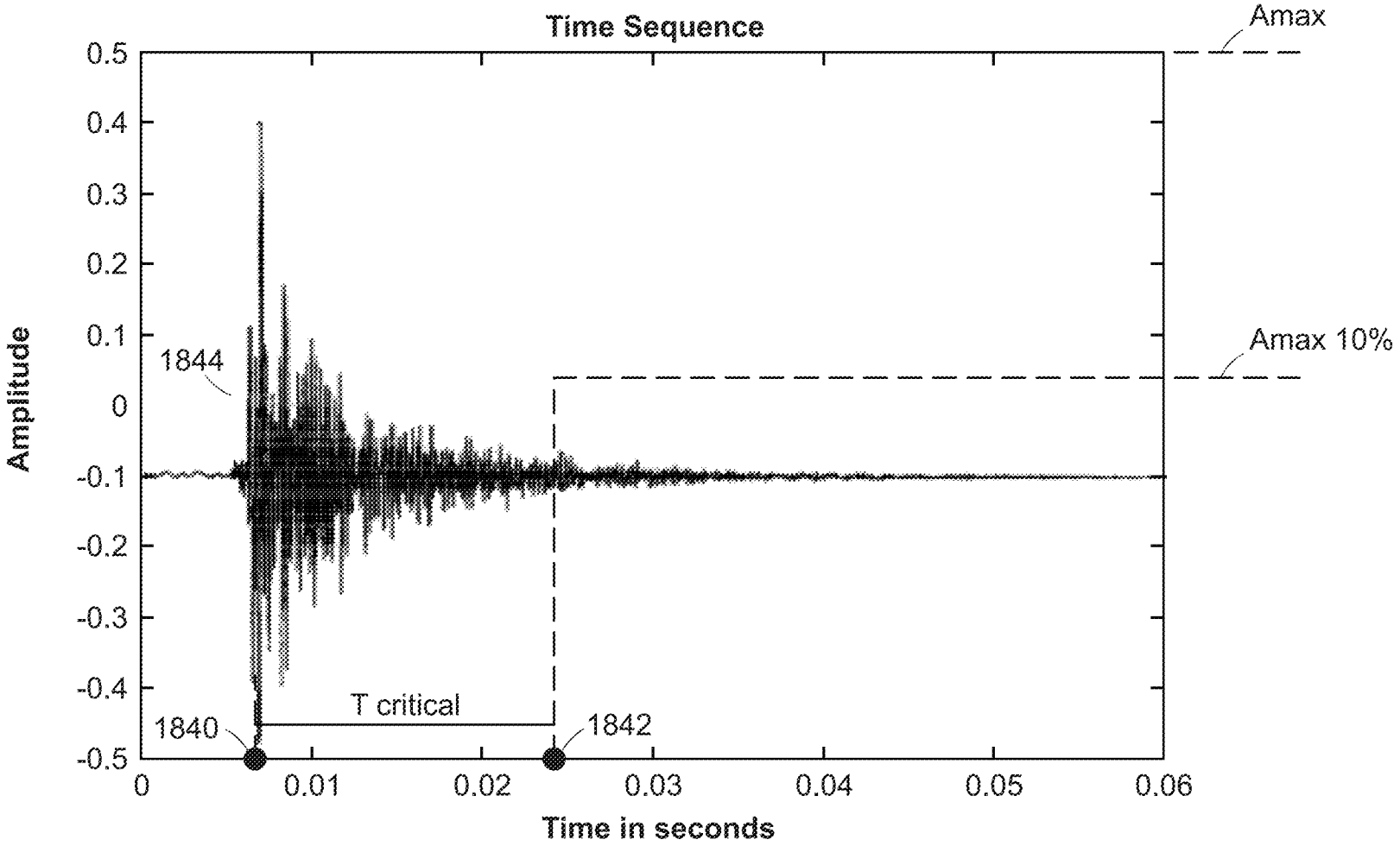
FIG. 18 of the accompanying drawings shows a time sequence diagram representing the amplitude of the sound of a golf club head in accordance with an embodiment of the present invention.

FIG. 18 of the accompanying drawing shows a time sequence diagram of the amplitude of the sound produced by the current inventive golf club head in accordance with an embodiment of the present invention. As the discussion previously indicated, the sound of the golf club head in accordance with the current inventive golf club head is one of the key factors in determining the performance of the golf club head. Before the discussion dives into the actual data, it is worthwhile to set forth the parameters of measurement of the present invention that will yield the results shown in FIG. 18. The time sequence diagram is created by gathering the audio profile using an audio recorder such as the TASCAM® DH-P2 Portable High Definition Stereo Audio recorder in conjunction with an A-weighting microphone. The recording is recorded at a distance of 39 inches away from the impact between the golf club head and the golf ball, which is determined as the distance that most closely simulates the distance to a golfer's ear as if he or she were hitting the golf club himself or herself. Data is sampled at 44.1 Hz to resolve the appropriate frequencies.

Moving onto the actual data shown in FIG. 18, we can see that on the x-axis, the time of the sound recording is shown in increments of 0.01 seconds; while on the other hand, on the y-axis shows the amplitude of the sound in millivolts. In the current sound recording shown in FIG. 18, it can be seen that the sound recording begins at a time 1844 right before impact with a golf ball and goes into a sinusoidal wave that reaches the peak amplitude $A_{max}$ at a time point 1840. Once the sound reaches the peak amplitude $A_{max}$ at time point 1840, the amplitude begins to resonate and begins decreasing until it dissipates completely. However, before it dissipates, it is worthwhile to note the point where the amplitude drops to beneath 10% of the peak amplitude $A_{max}$ it is of particular interest, as it defines a time point 1842 where the sound amplitude becomes borderline negligible to the naked ear. Due to the inherent oscillating tendencies of sound shown here in FIG. 18, the determination of when the sound oscillation actually reaches down to 10% of the peak amplitude $A_{max}$ can be difficult to discern visually. Hence, in order to help ease the determination, and in order to help pinpoint the oscillation variance inherent in these sound diagrams, the time where the amplitude is determined using a running average of the 5 most recent data points. In order to label this location of the 10% of the peak amplitude $A_{max}$ it is said to occur at time point 1842 shown in FIG. 18. In the current exemplary embodiment of the present invention, the peak amplitude $A_{max}$ is generally about 0.50 millivolts, occurring at a time point 1840 of about 0.007 seconds; while the diminished 10% peak amplitude $A_{max}$ occurs at a time point 1842 of about 0.025 seconds. The time that occurs between these the time points 1840 and 1842 is critical to recognize because it helps define a Critical Time $T_{critical}$. Critical Time $T_{critical}$ provides a way to quantify the quality and desirability of the sound of the golf club head as it impacts a golf ball. In the present embodiment of the present invention, the Critical Time $T_{critical}$ may be about 0.018 seconds.

A golf club head in accordance with the present invention may generally have a Critical Time $T_{critical}$ of greater than about 0.01 seconds and less than about 0.02 second, more preferably greater than about 0.015 seconds and less than about 0.02 seconds, and most preferably greater than about 0.0175 and less than about 0.02 seconds without departing from the scope and content of the present invention. Alternatively speaking, it can be said that the time it takes for the sound amplitude to go from the peak amplitude $A_{max}$ to an amplitude that is 10% of peak amplitude $A_{max}$ is defined as the Critical Time $T_{critical}$, and is generally greater than about 0.01 seconds and less than about 0.02 seconds, more preferably greater than about 0.015 seconds and less than about 0.02 seconds, and most preferably greater than about 0.0175 seconds and less than about 0.02 seconds.

Figure 19:
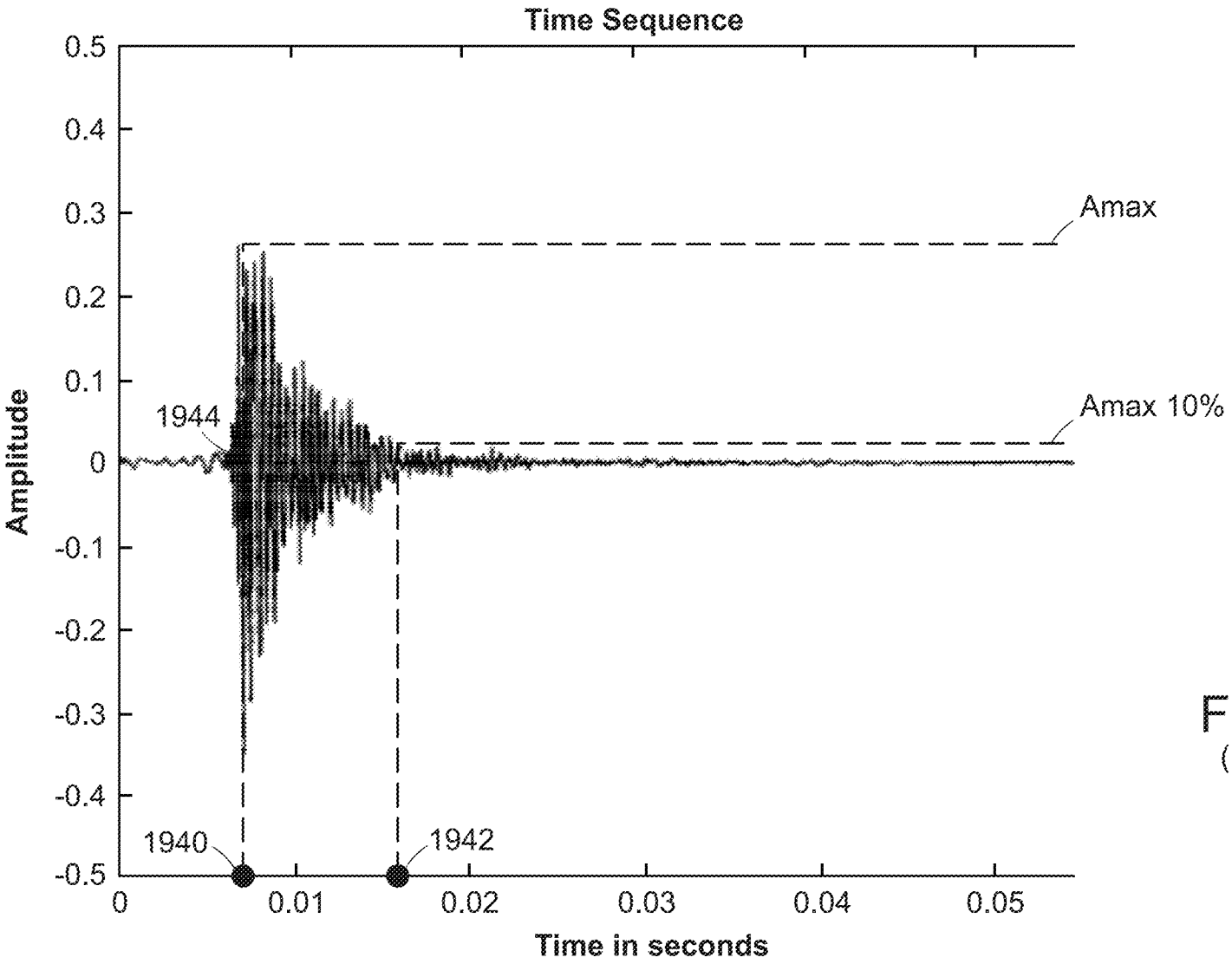
FIG. 19 (Prior Art)
FIG. 19 of the accompanying drawings shows a time sequence diagram representing the amplitude of the sound of an exemplary prior art golf club head.

FIG. 19 of the accompanying drawings provides an illustration of a time sequence diagram of a prior art golf club head that incorporates a composite crown technology that fails to recognize the importance of the sound component of a golf club head. As it can be seen from FIG. 19, not only the is peak amplitude $A_{max}$ significantly lower than the current inventive golf club head by being close to about 0.25 millivolts, it loses amplitude really quickly yielding a Critical Time $T_{critical}$ of less than about 0.01. In this exemplary prior art golf club head, the peak amplitude $A_{max}$ occurs at a time of about 0.008 second, while the diminished 10% of peak amplitude $A_{max}$ occurs at a time of about 0.015 second, yielding a Critical Time $T_{critical}$ of about 0.007 seconds, which is significantly less than the inventive golf club head $T_{critical}$ range of between about 0.01 seconds and 0.02 seconds. This prior art time sequence shown in FIG. 19 generally yields an undesirable sound, which the present invention avoids by adjusting the thickness ranges of the different materials and their respective layers.

Figure 20:
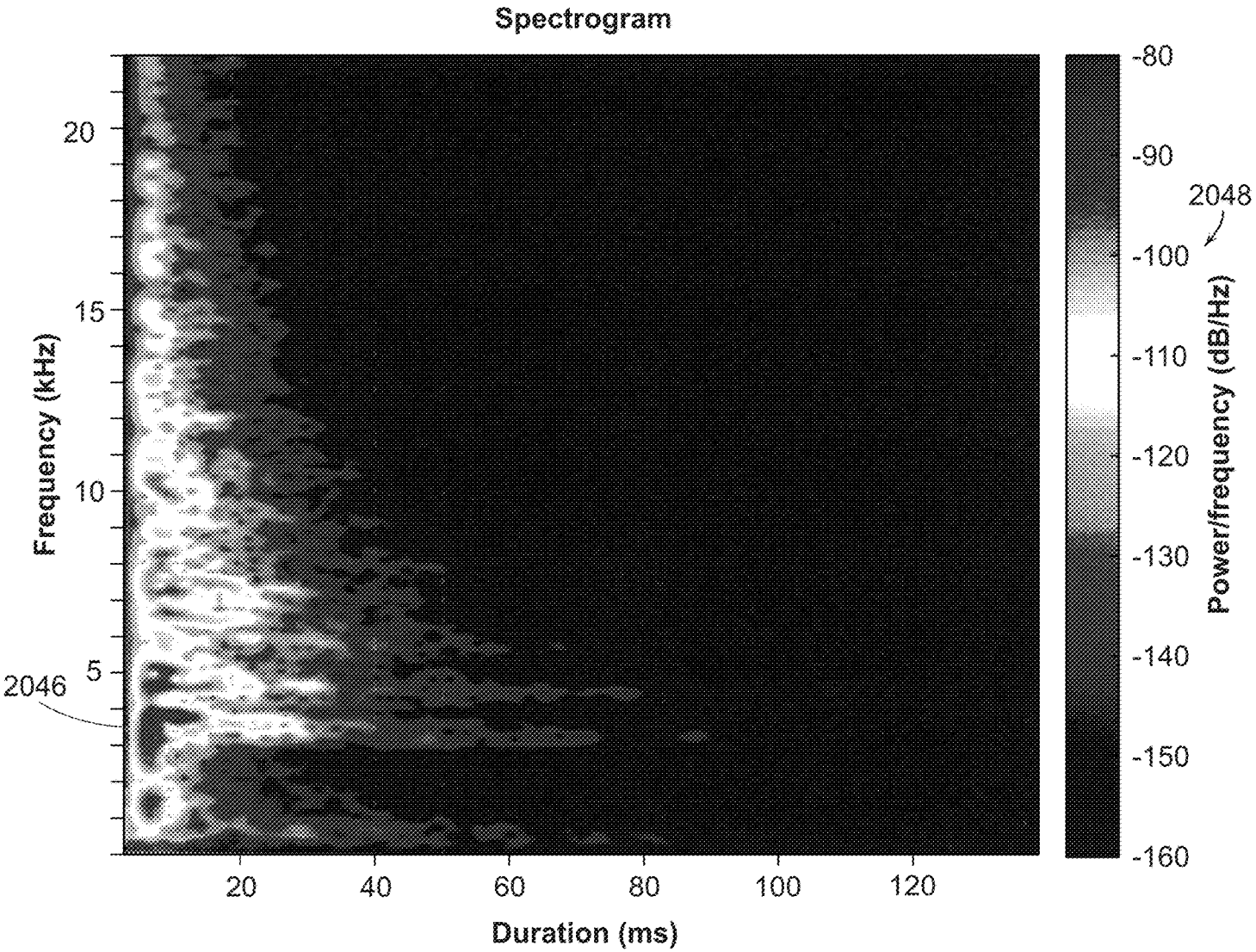
FIG. 20 of the accompanying drawings shows a spectrogram of the frequency and power of the sound of a golf club head in accordance with an embodiment of the present invention.

FIG. 20 provides more information regarding the acoustic signature of a golf club head that yields a desirable sound in accordance with the current inventive golf club head. Although the amplitude and duration of the sound is an important factor, it does not paint the entire picture about capturing the sound of a golf club head. More specifically, the third component in accurately capturing the sound of a golf club head is the frequency of the sound emitted by the golf club head during impact with a golf ball. FIG. 20 provides exactly this information by presenting a spectrogram that provides a visual representation of the spectrum of frequency of sound as it varies over time. Although the spectrogram provided in FIG. 20 contains a lot of information, the key feature to focus on is the dominant acoustic frequency 2046 occurring at a frequency that is above 3500 kHz. The dominant frequency is determined by the shading decided in the power/frequency chart 2048 on the right of the spectrogram itself shown in FIG. 20.

Figure 21:
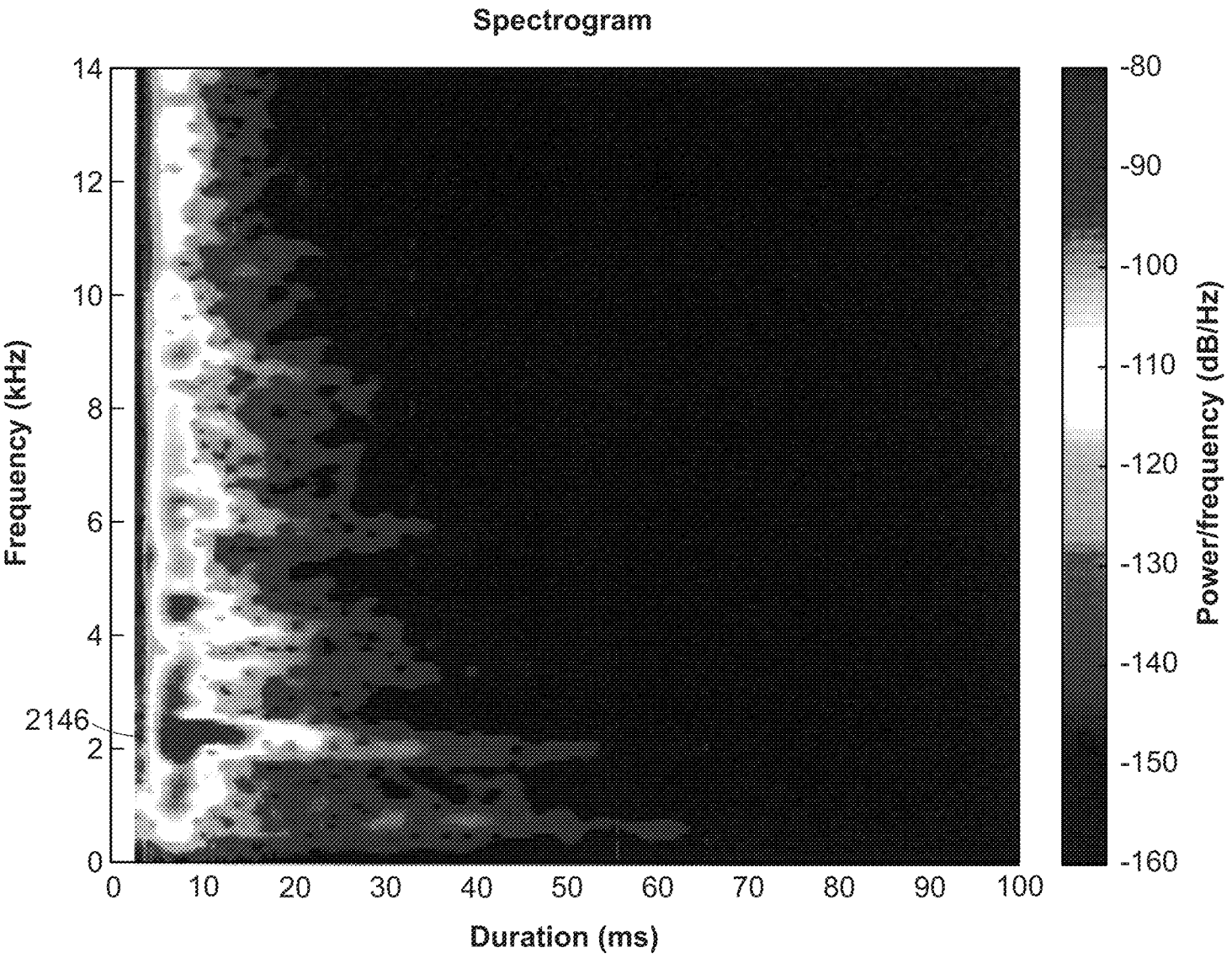
FIG. 21 (Prior Art)
FIG. 21 of the accompanying drawings shows a spectrogram of the frequency and power of the sound of a golf club head in accordance with a prior art golf club head.

Similar to the discussion above regarding the amplitude of the current inventive golf club head, to truly appreciate the difference in the spectrogram of the acoustic signature of the current golf club head, a prior art golf club head that contains an undesirable acoustic signature is presented here in FIG. 21. FIG. 21 of the accompanying drawings provides a spectrogram of a prior art golf club head that has composite material that produces an undesirable acoustic signature. Even a cursory examination of the spectrogram shown in FIG. 21 shows a clear difference from the current inventive golf club head spectrogram shown in FIG. 20. More specifically, a closer examination of FIG. 21 one can see that the dominant acoustic frequency 2146 occurs at a frequency that is significantly less than 3500 kHz, at a frequency of about 2100 kHz. This deficiency of frequency of 1100 kHz between this prior art golf club head and the current inventive golf club head, combined with the fast over damping of the amplitude of the golf club head explains the difference in a desirable acoustic signature and an undesirable acoustic signature previously discussed.

Finally, it is worth noting here that the panel member here may generally have its own resonate frequency of greater than 3300 kHz, which when combined with the other structures of the golf club head may yield the golf club head resonate frequency articulated above.

Figure 22:
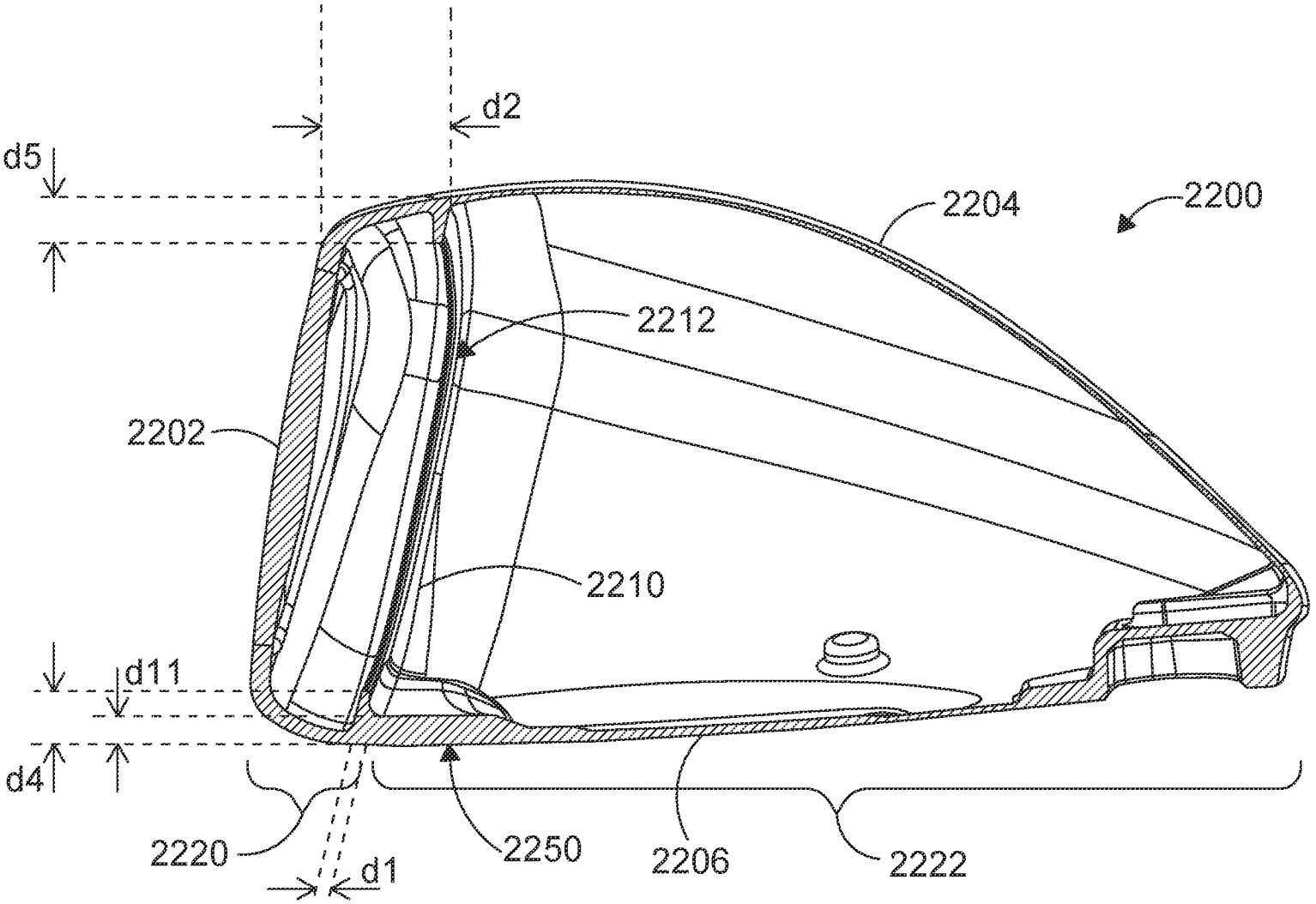
FIG. 22 of the accompanying drawings shows a cross-sectional view of a golf club head in accordance with an alternative embodiment of the present invention.

FIG. 22 of the accompanying drawings shows a cross-sectional view of a golf club head 2200 in accordance with an alternative embodiment of the present invention. Similar to previous embodiments of the present invention, the golf club head 2200 may generally have a striking face 2202 insert, a crown 2204 and a sole 2206. In a previous embodiment of the present invention, the crown 504 and the sole 506 (See FIG. 5) may be made out of an alternate lightweight material, in this embodiment of the present invention, the crown 2204 and the sole 2206 may generally be made out of the same titanium material that's generally associated with a metalwood type golf club head 2200. Despite the slightly different material structure for the golf club head 2200, the golf club head 2200 retains one of the key features of the present invention in having a panel member 2210 that separates the golf club head 2200 into a frontal acoustic chamber 2220 and a rear weight savings chamber 2222. The panel member 2210 shown in this embodiment of the present invention may also incorporate an oversized pressure release hole 2212 similar to golf club head 800 (shown in FIG. 8), but the present embodiment has a panel member 2210 and a pressure release hole 2212 dimensions that are tweaked due to the slightly different construction in the rear weight saving chamber 2222.

More specifically, FIG. 22, in order to illustrate and highlight these slightly different profiles, has highlighted several additional dimensions to help illustrate this difference in shape in geometry. Before diving into the specific dimensions, a brief description of the difference in geometry could be helpful in visualizing the difference between golf club head 2200 and golf club head 800 (shown in FIG. 8). Golf club head 2200 may generally have a panel member 2210 that has similar thickness d1 than previous embodiments, and is located at a setback distance d2 that is also similar to the previous embodiments. However, golf club head 2200 differs from the previous embodiment in that is has a more compact design for the panel member 2210 that incorporates a bigger pressure release hole 2212. In order to describe this new profile for the panel member 2210, d4 and d5 have been provided to illustrate this compact design. More specifically the crown panel member depth d5 may generally be between about 3 mm to about 8 mm, more preferably between about 3 mm to about 7 mm, and most preferably between about 3 mm to about 6 mm. The sole panel member depth d4 may generally be between about 3 mm to about 10 mm, more preferably between about 4 mm to about 9 mm, and most preferably between about 5 mm to about 8 mm.

Finally, FIG. 22 of the accompanying drawings illustrates another feature associated with the panel member 2200 in accordance with this alternative embodiment of the present invention, as it relates to a sole transition region with a thickened rearward support pad 2250. The sole transition region with a thickened rearward support pad 2250 in this embodiment is attached rearward of the panel member 2210, and offers structural support to the rigidity of that region to increase performance as well as increase durability. The sole transition region with a thickened rearward support pad 2250 may generally have a thickness of between about 4 mm to about 6 mm, more preferably between about 4.5 mm to about 5.5 mm, and most preferably about 5 mm, all without departing from the scope and content of the present invention.

Figure 23:
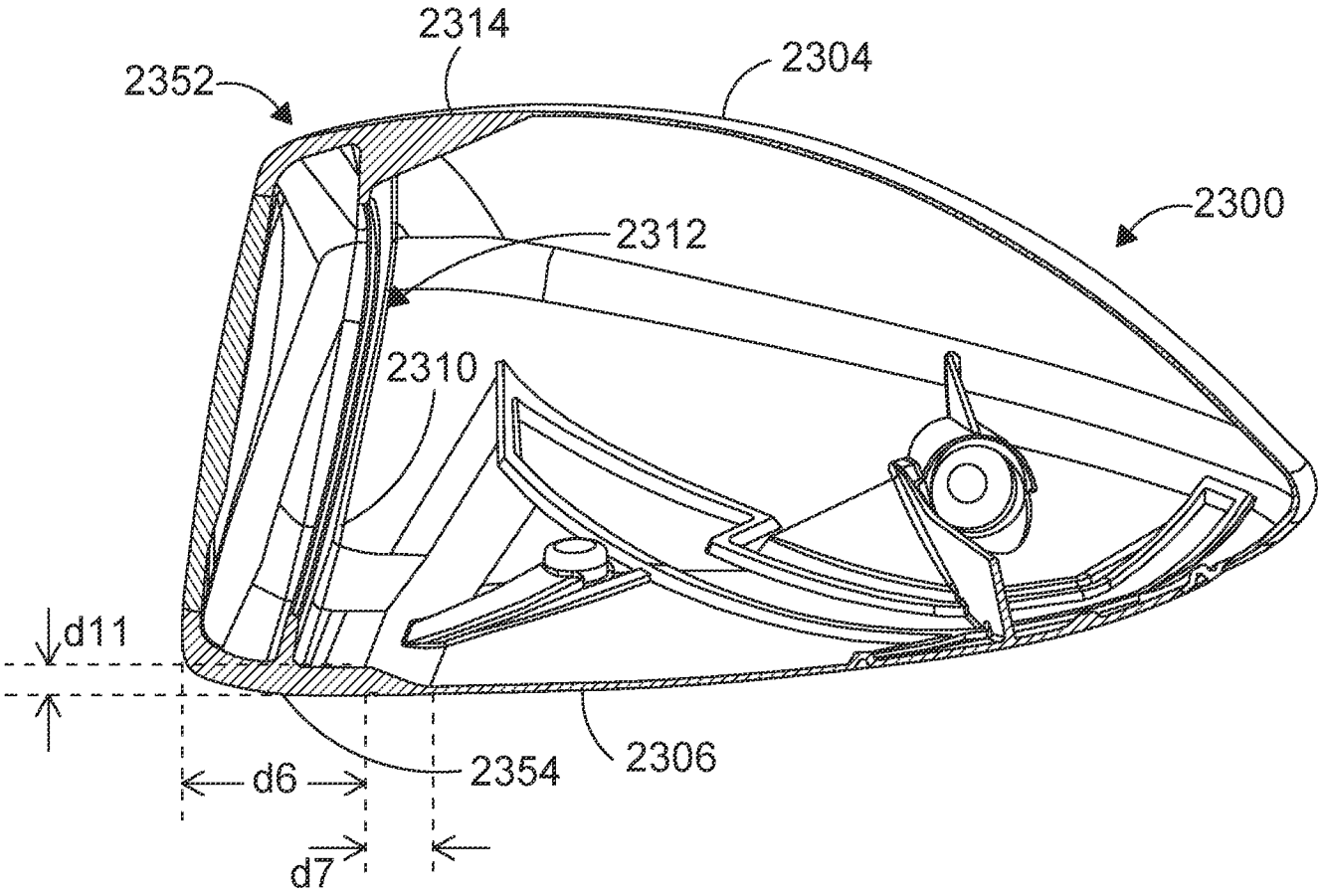
FIG. 23 of the accompanying drawings shows a cross-sectional view of a golf club head in accordance with a further alternative embodiment of the present invention.

FIG. 23 of the accompanying drawings shows a cross sectional view of a golf club head 2300 in accordance with an even further alternative embodiment of the present invention, allowing the various thicknesses of the crown 2304 and sole 2306 portion of the golf club head around the panel member 2310. As previously mentioned, the thickness of the sole transition region 2354 from the frontal striking face portion towards the sole 2306 may generally have a thickness d11 of between about 4.0 mm to about 6.0 mm, more preferably between about 4.5 mm to about 5.5 mm, and most preferably about 5 mm. This sole transition region 2354 having an increased thickness may generally extend backwards for a distance d6 of greater than about 15 mm, more preferably greater than about 17 mm, and most preferably greater than about 19 mm. This sole transition region 2354 having an increased thickness may generally help provide structural rigidity to the transition region between the striking face and the sole 2306 as well as the panel member 2310, and is critical in achieving the improved performance of the golf club head 2300.

FIG. 23 of the accompanying drawings also help identify a distance d7 from which the sole transition region 2354 slowly transitions from an area of increased thickness down to a standard sole thickness of less than about 0.65 mm. This transition region happens gradually over a distance d7 of about 3 mm to about 7 mm, more preferably over a distance d7 of about 4 mm to about 6 mm, and most preferably over a distance d7 of about 5 mm. Although not explicitly shown in this figure, the crown 2304 portion of the golf club head 2300 also has a crown transition region 2352 from the frontal striking face portion moving towards the crown, having similar measurements and dimensions as the sole transition region 2354. This crown transition region 2352 is not shown in this cross-sectional view of the golf club head 2300 because the crown transition region 2352 of the current golf club head 2300 incorporates a rib 2314 similar to the plurality of ribs 314*a* and 314*b* shown in FIG. 3. These ribs 2314 may serve the same purpose of increasing structural rigidity of the golf club head 2300 around the crown transition region 2352 as well as the panel member 2310.

Figure 24:
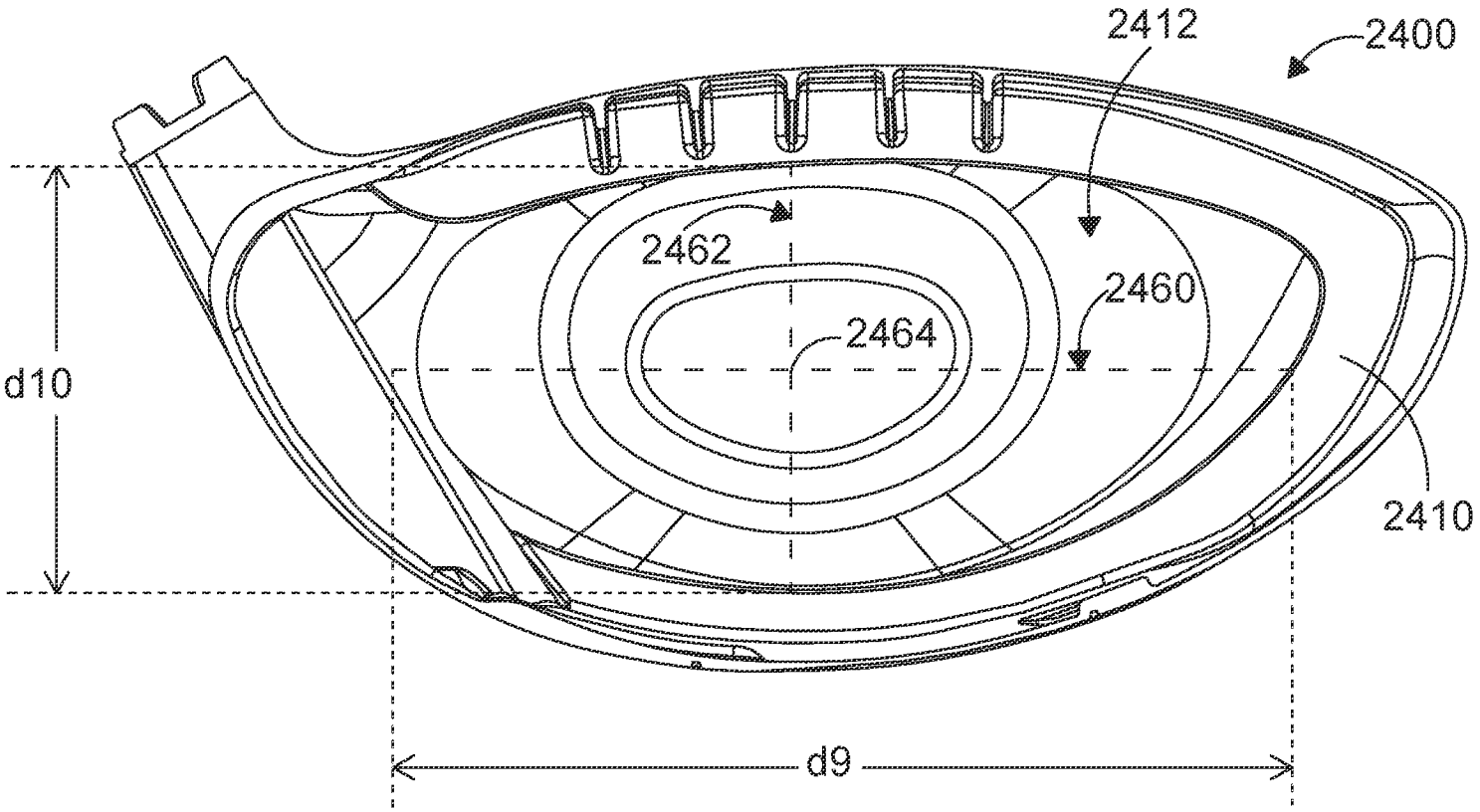
FIG. 24 of the accompanying drawings shows a rear cut away view of a golf club head in accordance with an alternative embodiment of the present invention.

FIG. 24 of the accompanying drawings shows a back view of a golf club head 2400 that is cut open, allowing the internals of the panel member 2410 to be shown more clearly. In this embodiment, the back view of the golf club head 2400 allows the size and dimension of the oversized pressure release hole 2412 is quantified as a measurement of the major axis 2460 distance d9 and a minor axis 2462 distance d10, both of which passes through a center of the face 2464. In this exemplary embodiment of the present invention, the major axis 2460 distance d9 may generally be greater than about 80 mm, more preferably greater than about 85 mm, and most preferably greater than about 87 mm. Please keep in mind that the heel side measurement of the major axis 2460 distance d9 in this embodiment may terminate at the hosel portion of the golf club head 2400 due to the fact that the panel member does not extend across the entire circumference of the golf club head 2400 itself. However, in an alternative embodiment of the present invention, the measurement of the major axis 2460 may terminate at the heel side of the panel member 810 when the panel member 810 extends across the entire circumference of the golf club head 800 as show in FIG. 8. The minor axis 2462 distance d10 of the oversized pressure release hole 2412 is also measured at the face center 2464, and may generally have a distance of greater than about 50 mm, more preferably greater than about 45 mm, and most preferably greater than about 43 mm.

The measurements of the major axis 2460 and the minor axis 2462 of the oversized pressure release hole 2412 can help create a relationship that defines the oval shape of the oversized pressure release hole 2412. This shape can be further quantified by an Aspect Ratio, defined in the present invention by Equation (3) below:

$$\text{Aspect Ratio} = \frac{\text{Major Axis 2460 Distance } d9}{\text{Minor Axis 2462 distance } d10} \qquad \text{Eq. (3)}$$

The oversized pressure release hole 2412 in accordance with this embodiment of the present invention may generally have an Aspect Ratio between about 1.6 and about 2.0, more preferably between about 1.7 to about 1.9, and most preferably about 1.8, all without departing from the scope and content of the present invention.

Figure 25:
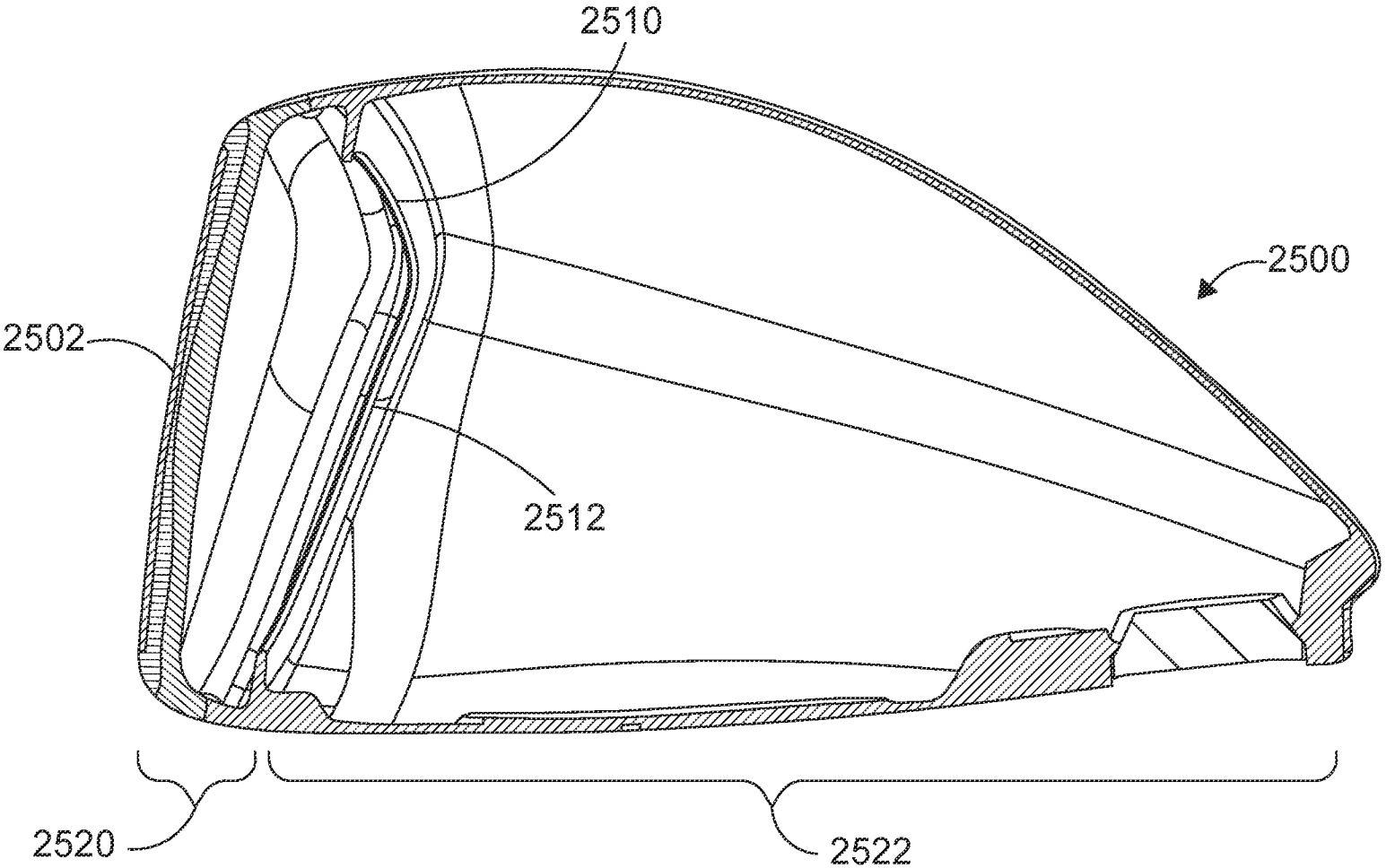
FIG. 25 of the accompanying drawings shows a cross-sectional view of a golf club head in accordance with an even further alternative embodiment of the present invention.

FIG. 25 of the accompanying drawings shows a golf club head 2500 in accordance with an even further alternative embodiment of the present invention. In this alternative embodiment of the present invention the striking face insert 2502 may be slightly different from the basic insert having a variable thickness. Instead, the striking face insert 2502 may generally be further comprised out of an external frontal face layer, an internal rear face layer, and an intermediary sandwiched face layer, wherein the internal rear face layer has a non-uniform thickness created by a substantially planer rear surface and a substantially non-planar front surface. Support for this new sandwiched layer striking face insert 2502 can be found in U.S. Provisional Patent Application 62/876,432, filed on Jul. 19, 2019, the disclosure of which is incorporated by reference in its entirety.

Ultimately, this golf club head 2500 comprises the new sandwiched layer striking face insert 2502 and the current golf club head 2500 having a frontal acoustic chamber 2520 and a rear weight savings chamber 2522 separated by a panel member 2510 having an oversize pressure release hole 2512. The harmony between the various components shown in FIG. 25 not only achieves all of the performance benefits previously articulated via this construction, but further enhances the performance of the golf club head 2500 by incorporating benefits that can be achieved by the new sandwiched layer striking face insert 2502.

Figure 26:
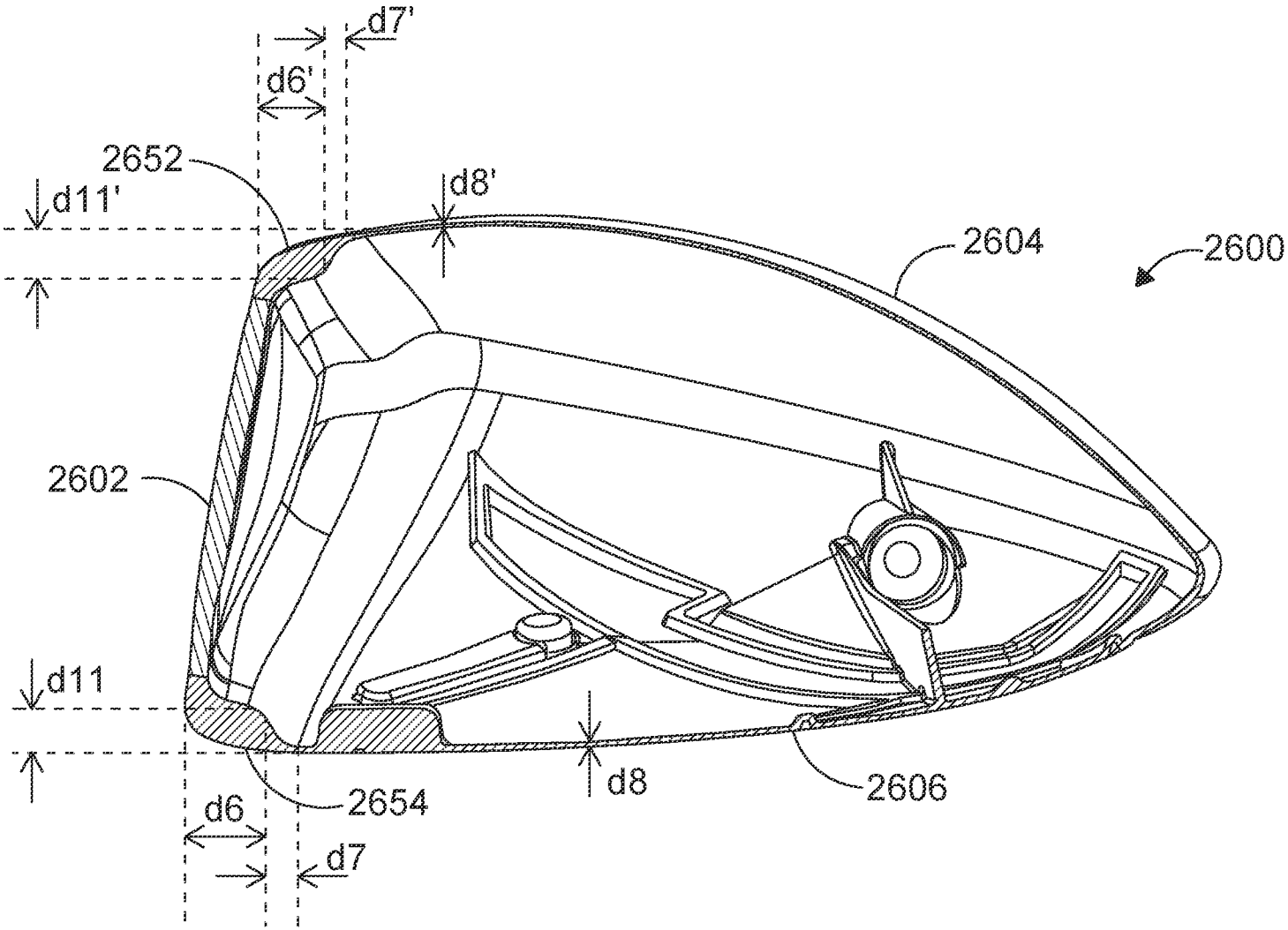
FIG. 26 of the accompanying drawings shows a cross-sectional view of a golf club head in accordance with an even further alternative embodiment of the present invention.

FIG. 26 of the accompanying drawings shows a cross-sectional view of a golf club head 2600 in accordance with an even further alternative embodiment. In this alternative embodiment of the present invention, the golf club head 2600 may have a crown 2604, a sole 2606, and a striking face insert 2602 forming the golf club head 2600 as previously mentioned. However, different from prior embodiments of the present invention, golf club head 2600 does not have a panel member to bifurcate the golf club head 2600 into a frontal acoustic chamber and a rear weight saving chamber. Instead, golf club head 2600 attempts to replicate the performance of the panel member via an extreme manipulation of the thicknesses of the transition region between the striking face portion and the body portion of the golf club head 2600. In order to illustrate this thickness variation of the transition region, FIG. 26 has identified several different thicknesses both on the crown transition region 2652 and the sole transition region 2654. First off, the sole transition region 2654 thickness d11 may generally be between about 4.0 mm to about 6.0 mm, more preferably between about 4.5 mm to about 5.5 mm, and most preferably about 5 mm. The thickened sole transition region 2654 may have a depth d6 of between about 3 mm to about 7 mm, more preferably between about 4 mm to about 6 mm, and most preferably about 5 mm. Rearward of the thickened sole transition region 2654, the thickened transition region gradually decreases in thickness towards a rear end of said sole transition region that gradually spans over a distance d7 of 4 mm from a thickness of about 5 mm to a sole thickness d8 of about 0.65 mm.

The crown transition region 2652 thickness d11' may generally be between about 3.0 mm to about 4.5 mm, more preferably between about 3.5 mm to about 4.0 mm, and most preferably about 3.75 mm. The thickened crown transition region 2652 may generally have a depth d6' of between about 8 mm to about 12 mm, more preferably between about 9 mm to about 11 mm, and most preferably about 10 mm. Rearward of the thickened crown transition region 2652, the thickened transition region gradually decreases in thickness towards a rear end of said crown transition region that spans over a distance d7' of 2 mm from a thickness of about 3.75 mm to a crown thickness d8' of about 0.4 mm. This relationship between the crown transition region 2652 and the sole transition region 2654 may help replicate the performance gains obtained by the panel member without actually having the panel member, thus improving the performance of the golf club head 2600 without the need for extraneous components. Having these sole transition region 2654 and crown transition region 2652 thicknesses in the range described above is critical to the proper functionality of the present invention because it allows for the creation of a specific thickness relationship between the crown region and the sole region, creating the performance gains of the golf club head 2600.

Other than in the operating example, or unless otherwise expressly specified, all of the numerical ranges, amounts, values and percentages such as those for amounts of materials, moment of inertias, center of gravity locations, loft, draft angles, various performance ratios, and others in the aforementioned portions of the specification may be read as if prefaced by the word "about" even though the term "about" may not expressly appear in the value, amount, or range. Accordingly, unless indicated to the contrary, the numerical parameters set forth in the above specification and attached claims are approximations that may vary depending upon the desired properties sought to be obtained by the present invention. At the very least, and not as an attempt to limit the application of the doctrine of equivalents to the scope of the claims, each numerical parameter should at least be construed in light of the number of reported significant digits and by applying ordinary rounding techniques.

Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements. Furthermore, when numerical ranges of varying scope are set forth herein, it is contemplated that any combination of these values inclusive of the recited values may be used.

It should be understood, of course, that the foregoing relates to exemplary embodiments of the present invention and that modifications may be made without departing from the spirit and scope of the invention as set forth in the following claims.

What is claimed is:

1. A golf club head comprising:

a frontal striking face portion located at a frontal end of said golf club head;

a rear body portion located at a rear portion of said golf club head;

a crown transition region, juxtaposed between said frontal striking face portion and said rear body portion, at a crown portion of said golf club head; and a sole transition region, juxtaposed between said frontal striking face portion and said rear body portion, at a sole portion of said golf club head, wherein said crown transition region has a thickness of between about 3.0 mm to about 4.5 mm and a depth of between about 8 mm to about 12 mm, wherein said sole transition region has a thickness of between about 4.0 mm to about 6.0 mm and a depth of between about 3 mm to about 7 mm, wherein said thickness of said crown transition region is thinner than said thickness of said sole transition region, and wherein a rear end of said crown transition region gradually decreases in thickness down to about 0.4 mm over a span of 2 mm.

2. The golf club head of claim 1, wherein said thickness of said crown transition region is between about 3.5 mm to about 4.0 mm and said depth of said crown transition region is between about 9 mm to about 11 mm, and wherein said thickness of said sole transition region is between about 4.5 mm to about 5.5 mm and said depth of said sole transition region is between about 4 mm to about 6 mm.

3. The golf club head of claim 2, wherein said thickness of said crown transition region is about 3.75 mm for a depth of about 10 mm, and wherein said thickness of said sole transition region is about 5 mm for a depth of about 5 mm.

4. The golf club head of claim 1, wherein a ratio of a crown transition slope divided by a sole transition slope is between about 0.125 to about 1.096;

said crown transition slope defined as said thickness of said crown transition region divided by said depth of said crown transition region, said sole transition slope defined as said thickness of said sole transition region divided by said depth of said sole transition region.

5. The golf club head of claim 4, wherein said ratio of said crown transition slope divided by said sole transition slope is between about 0.237 to about 0.58.

6. The golf club head of claim 5, wherein said ratio of said crown transition slope divided by said sole transition slope is about 0.375.

7. The golf club head of claim 1, wherein said golf club head has a Critical Time $T_{critical}$ of greater than about 0.01 second and less than about 0.02 second;

wherein Critical Time $T_{critical}$ is defined as the amount of time it takes for the sound amplitude of said golf club head to go from the peak amplitude $A_{max}$ to an amplitude that is 10% of peak amplitude $A_{max}$.

8. The golf club head of claim 7, wherein said Critical Time $T_{critical}$ of greater than about 0.015 second and less than about 0.02 second.

9. The golf club head of claim 8, wherein said Critical Time $T_{critical}$ of greater than about 0.0175 second and less than about 0.02 second.

10. A golf club head comprising:

a frontal striking face portion located at a frontal end of said golf club head;

a rear body portion located at a rear portion of said golf club head;

a crown transition region, juxtaposed between said frontal striking face portion and said rear body portion, at a crown portion of said golf club head; and a sole transition region, juxtaposed between said frontal striking face portion and said rear body portion, at a sole portion of said golf club head, wherein said crown transition region has a crown transition slope between about 0.25 to 0.625, said crown transition slope defined as a thickness of said crown transition region divided by a depth of said crown transition region, wherein said sole transition region has a sole transition slope of between about 0.57 to about 2, said sole transition slope defined as a thickness of said sole transition region divided by a depth of said sole transition region, wherein said depth of said crown transition region is greater than said depth of said sole transition region, and wherein a rear end of said sole transition region gradually decreases in thickness down to about 0.65 mm over a span of 4 mm.

11. The golf club head of claim 10, wherein said crown transition slope is between about 0.32 to 0.44, and wherein said sole transition region slope is between about 0.75 to about 1.375.

12. The golf club head of claim 11, wherein said crown transition slope is about 0.375, and wherein said sole transition slope is about 1.

13. The golf club head of claim 10, wherein said golf club head has a Critical Time $T_{critical}$ of greater than about 0.01 second and less than about 0.02 second;

wherein Critical Time $T_{critical}$ is defined as an amount of time it takes for a sound amplitude of said golf club head to go from a peak amplitude $A_{max}$ to an amplitude that is 10% of said peak amplitude $A_{max}$.

14. The golf club head of claim 13, wherein said Critical Time $T_{critical}$ is greater than about 0.015 second and less than about 0.02 second.

15. The golf club head of claim 14, wherein said Critical Time $T_{critical}$ is greater than about 0.0175 second and less than about 0.02 second.

16. The golf club head of claim 13, wherein a ratio of said crown transition slope divided by said sole transition slope is between about 0.125 to about 1.096.

17. The golf club head of claim 16, wherein said ratio of said crown transition slope divided by said sole transition slope is between about 0.237 to about 0.58.

18. The golf club head of claim 17, wherein said ratio of said crown transition slope divided by said sole transition slope is about 0.375.

19. A golf club head comprising:

a frontal striking face portion located at a frontal end of said golf club head;

a rear body portion located at a rear portion of said golf club head;

a crown transition region, juxtaposed between said frontal striking face portion and said rear body portion, at a crown portion of said golf club head; and a sole transition region, juxtaposed between said frontal striking face portion and said rear body portion, at a sole portion of said golf club head, wherein said crown transition region has a thickness of between about 3.0 mm to about 4.5 mm and a depth of between about 8 mm to about 12 mm, wherein said sole transition region has a thickness of between about 4.0 mm to about 6.0 mm and a depth of between about 3 mm to about 7 mm, wherein said thickness of said crown transition region and said thickness of said sole transition region are different, wherein said depth of said crown transition region and said depth of said sole transition region are different, wherein a rear end of said sole transition region gradually decreases in thickness down to about 0.65 mm over a span of 4 mm, and wherein a rear end of said crown transition region gradually decreases in thickness down to about 0.4 mm over a span of 2 mm.

* * * * *